United States Patent [19]

Shriver

[11] Patent Number: 4,558,421

[45] Date of Patent: Dec. 10, 1985

[54] CONTROL SYSTEM FOR AN AUTOMATIC LADLING APPARATUS

[75] Inventor: Ronald D. Shriver, Pataskala, Ohio

[73] Assignee: Yellowstone, Ltd., Columbus, Ohio

[21] Appl. No.: 616,906

[22] Filed: Jun. 4, 1984

Related U.S. Application Data

[63] Continuation-in-part of Ser. No. 502,753, Jun. 9, 1983, abandoned.

[51] Int. Cl.[4] ..... G06G 7/66

[52] U.S. Cl. ..... 364/477; 364/472; 364/476; 364/479; 364/513; 364/174; 164/155; 164/337; 164/457; 222/590; 222/594; 222/604; 222/166; 266/96

[58] Field of Search ..... 364/468, 472, 476, 477, 364/479, 174, 513; 164/155, 157, 337, 457; 222/590, 591, 594, 604, 166; 266/78, 96

[56] References Cited

U.S. PATENT DOCUMENTS

| | | | |
|---|---|---|---|
| 3,478,808 | 11/1969 | Adams | 364/477 |
| 3,920,972 | 11/1975 | Corwin, Jr. et al. | 364/513 |
| 3,977,460 | 8/1976 | Badone et al. | 164/155 |
| 4,112,998 | 9/1978 | Sato | 164/155 |
| 4,134,444 | 1/1979 | Fujie et al. | 164/155 |
| 4,210,192 | 7/1980 | Lavanchy et al. | 164/155 |
| 4,245,758 | 1/1981 | McCabe | 222/591 |
| 4,289,259 | 9/1981 | O'Brien | 222/590 |
| 4,450,887 | 5/1984 | Wilkins | 164/155 |

*Primary Examiner*—Jerry Smith
*Assistant Examiner*—John R. Lastova
*Attorney, Agent, or Firm*—Pearne, Gordon, Sessions, McCoy, Granger & Tilberry

[57] ABSTRACT

A control system operates an automatic ladling apparatus for conveying molten metal from a furnace to a die casting machine or the like. The control system includes a plurality of adjustable speed control settings so that the speed of the apparatus can be varied according to operating conditions. The rate at which molten metal is poured into the die casting machine may also be varied. The position of the apparatus is monitored so that speed is automatically varied according to the position, and these positions are programmable. The control system includes an abort sequence to pour molten metal back into the furnace automatically if the die casting machine is not ready to accept the pour.

14 Claims, 20 Drawing Figures

CONTROL SYSTEM FOR AN AUTOMATIC LADLING APPARATUS

This application is a continuation-in-part of U.S. patent application Ser. No. 502,753, filed June 9, 1983, now abandoned.

BACKGROUND OF THE INVENTION

This invention relates to the pouring of molten metal such as aluminum into a molding apparatus, such as a die casting machine. More particularly, the invention relates to a control system for a ladling apparatus operative to mechanically receive a measured charge of molten metal from a holding furnace or crucible, transport it a desired distance, and pour it into the molding apparatus preparatory to the molding operation, and especially to a control system for an automatic ladling machine specifically adapted for use in association with die casting machines.

This invention relates to and incorporates by reference herein the disclosure of the U.S. patent application of Charles A. Burton and Peter Banovic entitled "Automatic Ladling Apparatus," filed June 9, 1983.

Automatic ladling devices generally comprise a conveyor mechanism with a ladle dipper attached thereto and adapted to be conveyed thereby between a crucible or furnace and a die casting machine. The ladle dipper automatically descends into the furnace to draw a supply of molten metal and is then transported by the conveying mechanism from the furnace to the die casting machine, where the metal is poured into an appropriate receiver.

A typical ladling apparatus of this type is disclosed in U.S. Pat. No. 3,923,201.

In the prior art, the ladling apparatus is installed for use in association with a specific furnace and molding machine, the installation requiring careful positioning and adjustment of heights and the like so that the path of travel of the ladle dipper is carefully matched to the furnace and die casting machine positions. The installation and adjustment are time-consuming operations and, once completed, are difficult to change. Often, however, due to changes in molds, furnaces, and the like in the die casting facility, a change in position is necessary, all of which requires extensive adjustment of the ladling apparatus. The ladling apparatus of the present invention, however, provides greatly improved adjustability and flexibility and affords many other features and advantages heretofore not obtainable.

SUMMARY OF THE INVENTION

It is among the objects of the present invention to provide improved accuracy in the transporting of molten metal from a furnace to a die casting machine.

Another object is to provide improved reliability in such a machine as well as safety features that minimize malfunctions and loss of castings due to defects.

Still another object is to provide a ladling apparatus having a control system which automatically operates at adjustable varying speeds so that the speed of pouring of the molten metal may be adjusted according to the die casting being performed.

These and other objects and advantages are obtained with the novel control system for a ladling apparatus of the present invention, which includes a plurality of speed control settings to permit the apparatus to move at varying speeds. The speed control settings are adjustable so that the various speeds may be set according to operating conditions in which the ladling apparatus is used. The control system also provides for a plurality of pouring speeds so that the molten metal may be poured into the die casting machine at varying rates. These pouring speeds are also adjustable, and the pouring rates may be changed depending upon the configuration of the mold in the die casting machine and other operating conditions. Thus, the pouring rate may be contoured for each particular situation.

The control system varies the preset speeds depending upon the positioning of the apparatus, and means are provided for monitoring the position of the apparatus. The monitoring means is preferably programmable, at least in part, so that the position of the apparatus at which the speeds are changed may also be varied according to the operating conditions in which the ladling apparatus is used. In accordance with a preferred embodiment of the invention, the monitoring means comprises shaft encoders connected to the control unit. In addition, limit switches may be used to monitor the position of the apparatus, and metal level sensing probes may be used to detect the position of the apparatus relative to the supply of molten metal. The limit switches and metal level probes provide monitoring means which are not programmable.

The control system also includes an abort sequence that operates in association with a ladle tilt mechanism to pour molten metal from the ladle dipper back into the molten metal supply if pouring is not begun within a specified time. The abort system includes a timer which is initiated when the monitoring means indicates that the apparatus is in a position where it is ready to pour, and interlocks from the die casting machine indicating that the machine is ready to accept metal. If the timer times out before the machine is ready, the control system causes the apparatus to retract to the molten metal supply and dump the metal back in.

DESCRIPTION OF THE PREFERRED EMBODIMENT

Figure 1:
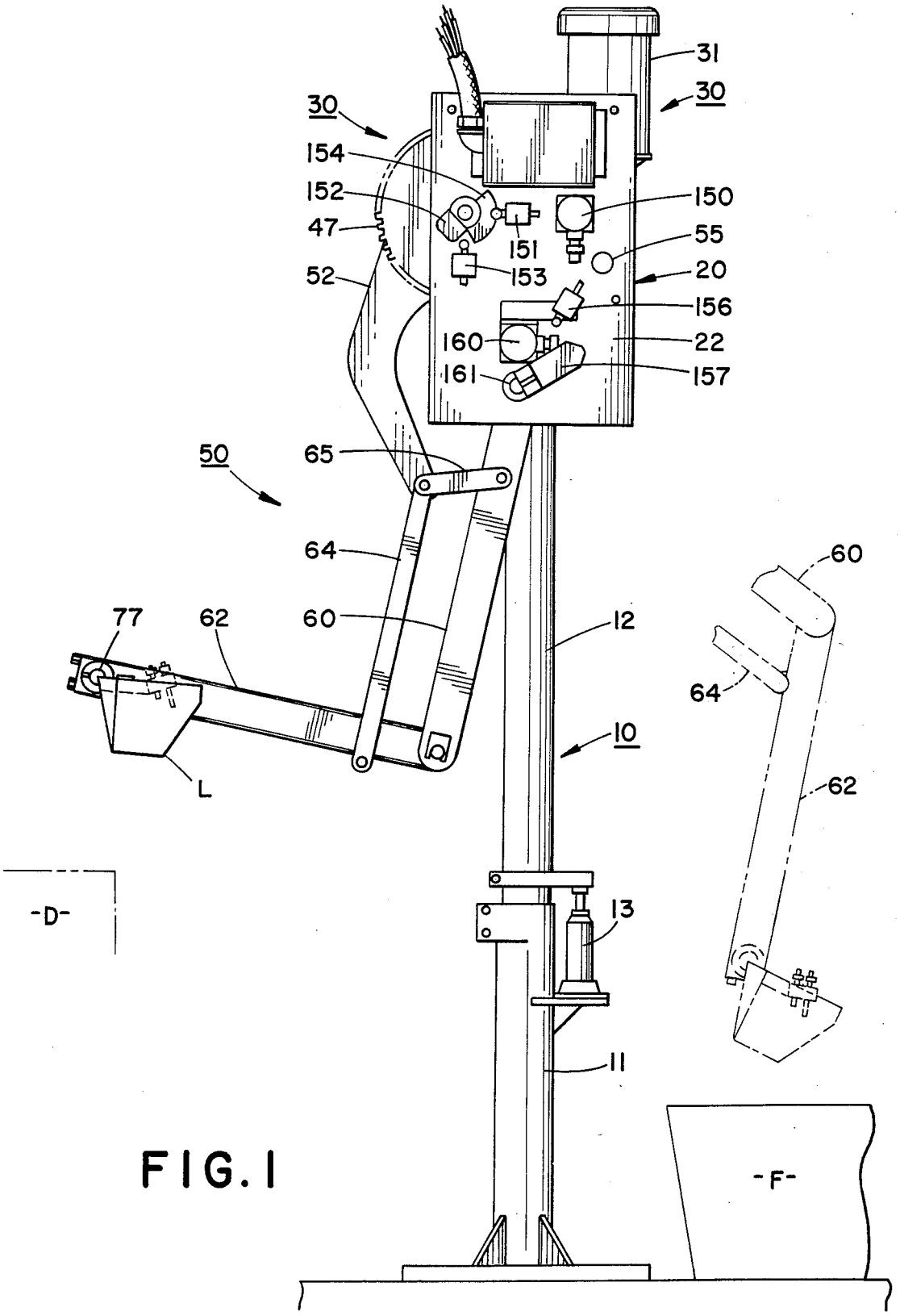
FIG. 1 is a front elevation of an automatic ladling apparatus used in connection with the invention and showing the ladle transport assembly in a partially extended position in sold lines and in a partially retracted position in solid lines.
Figure 2:
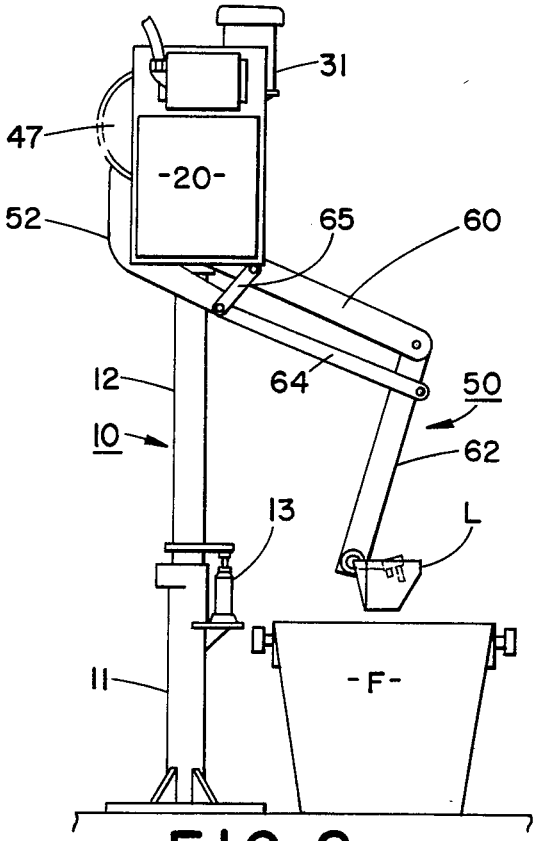
FIGS. 2 through 5 are diagrammatic views illustrating various positions of the apparatus during a ladling cycle.

Referring more particularly to the drawings, and initially to FIGS. 1 through 6, there is shown an apparatus for transporting a ladle dipper L adapted to contain a charge of molten metal, in a controlled path of travel between a furnace F and an appropriate receiver in a die casting machine D. The apparatus includes as basic components a pedestal assembly 10 that supports a drive assembly 30, which in turn operates a ladle transport assembly 50, and a ladle tilt assembly 100.

The pedestal assembly 10 includes a generally vertical base tube 11, an upper tube 12 slidably received in the base tube 11, and an adjusting cylinder 13 adapted to raise and lower the upper tube 12 relative to the base tube 11 for the purpose of adjusting the apparatus relative to the furnace height.

The main housing 20 includes a pair of vertical, parallel side plates 22 and 23 (FIG. 8) located relative to one another by spacer sleeves 25. Also each of the side plates 22 and 23 has several corresponding bores formed therein for bearings in which the various shafts of the drive assembly 30 are journaled.

Drive Assembly

Figure 8:
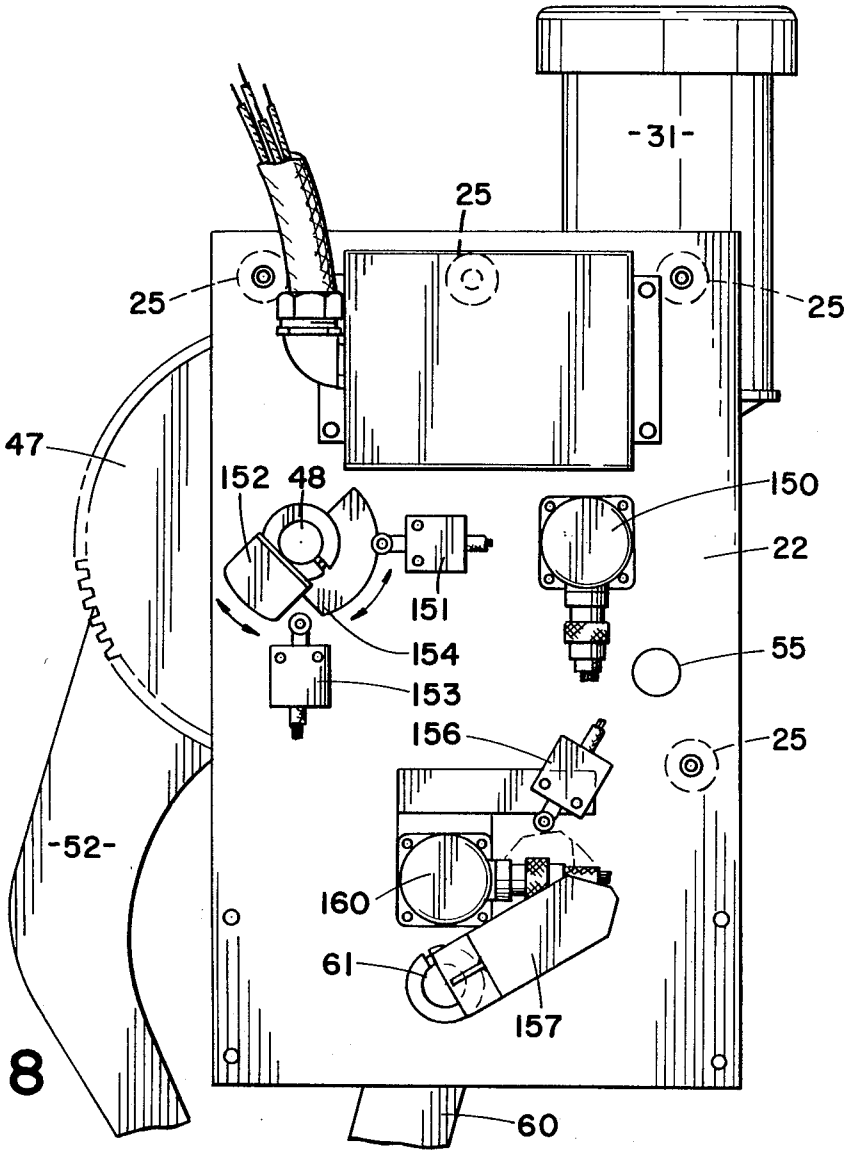
FIG. 8 is a fragmentary, front elevation on an enlarged scale of the apparatus of FIG. 1.

The drive assembly 30 includes a reversible DC motor 31 and an associated worm-type gear reduction unit 32 with an output shaft 33, as best illustrated in FIG. 8. The shaft 33 has a pinion 34 that meshes with a large drive gear 47 keyed to a shaft 48 journaled at its ends in the side plates 22 and 23. The drive gear 47 provides the drive for the ladle transport linkage which carries the ladle dipper L through its operating cycles.

Ladle Transport Assembly

The movement provided by the ladle transport assembly 50 is best illustrated in FIGS. 1 and 3 through 6, wherein it will be seen that the path of movement (shown in dashed lines in FIG. 1) includes a generally horizontal span that extends to a pour position adjacent the die casting machine at one end and a downwardly curved, generally vertical portion wherein the ladle dipper L is dipped into the furnace at the opposite end or the right hand end as viewed in FIG. 1.

Figure 9:
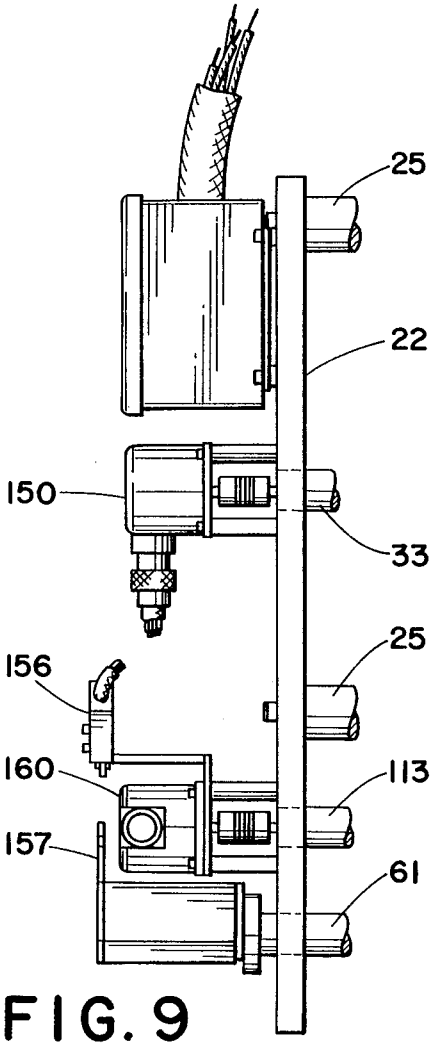
FIG. 9 is a fragmentary end elevation on an enlarged scale of tne apparatus of FIG. 1.

The assembly 50 includes a generating arm 52 pivottally connected at one end to the drive gear 47 by a pivot pin 53. The shape of the generating arm is best shown in FIG. 9. The movement of the motion generating arm 52 is controlled by both the gear 47 and a rocking link 54 which is pivotally supported on a shaft 55 journaled between the plates 22 and 23, and which is also pivotally connected to the motion generating arm 52 by a pivot pin 56.

It will be noted that the motion produced at the outer end of the motion generating arm 52, resulting from the movement of the drive gear 47 and rocking link 54 (see FIGS. 3 through 6), includes primarily horizontal and vertical components corresponding generally, but on a reduced scale, to the ladle movement illustrated in dashed lines in FIG. 1. In order to compensate for the variable loads that occur during operation of the linkage so far described, a helical counterbalance spring 57 is adapted to urge the rocking link 54 toward its upward position illustrated in FIG. 9. The counterbalance spring 57 is mounted on a rod that extends between a lower support shaft 58 mounted between the sideplates 22 and 23 and a swivel pin 59 mounted on the rocking link 54.

The motion produced at the outer end of the motion generating arm 52 is transferred to another link assembly that includes a main link 60 pivotally connected to the main housing 20 by journal bearings on a pivot shaft 61, and a carrier link 62 adapted to carry the ladle dipper L at its outer end and pivotally connected by a pivot pin 63 to the outer end of the main link 60. The main link 60 and carrier link 62 are each connected to the lower end of the generating arm 52 by a pair of control links 64 and 65, respectively, with one end of each connected to one another and to the other end of the motion generating arm 52 by a pivot pin 66.

The opposite end of the link 64 is connected to a central portion of the main link 60 by a pivot pin 67 and the opposite end of the link 65 is pivotally connected to the mid-portion of the carrier link 62 by a pivot pin 68. With this arrangement, it will be seen that the motion produced at the end of the generating arm 52 is magnified by the link assembly 60, 62, 64, and 65 to produce the path of travel generally shown by dashed lines in FIG. 1.

The ladle dipper L is supported at the outer end of the carrier link 62 by means of a shaft 77 associated with the ladle tilt assembly 100.

The shaft 77 has a bracket 78 secured to one end by a bolt 79. The bracket 78 is of a generally L-shaped configuration and the ladle dipper L is mounted thereto at the base of the "L" by means of a nut 83.

The ladle dipper L is of generally conventional design, and includes a pour spout 84 at one end and a fill slot 85 at the opposite side with a lip 86 extending outwardly along the upper part of the slot. The tip of the pour spout 84 is located at the axis of the shaft 77 so that during pouring the dipper L essentially pivots about its own spout.

The carrier link 62 has a bracket 90 secured thereto adapted to carry three metal level sensing probes 91, 92, and 93 (FIGS. 1 and 9) forming part of the control system for the apparatus, to be described in detail below. The probes are lowered into the furnace coincidentally with the lowering of the ladle dipper L into the furnace to obtain a charge of molten metal. The probes 91 and 92 each comprise electrical conductors capable of conducting low current and as they contact molten metal, an electrical connection is made between them. Accordingly, when they first reach the level of molten metal in the furnace F, they provide an electrical signal that is used to halt the downward movement of the ladle dipper L in an appropriate position to begin drawing molten metal from the furnace. The probe 93 is much shorter and is used to sense a "high metal level" condition in the furnace.

Ladle Tilt Assembly

Figure 3:
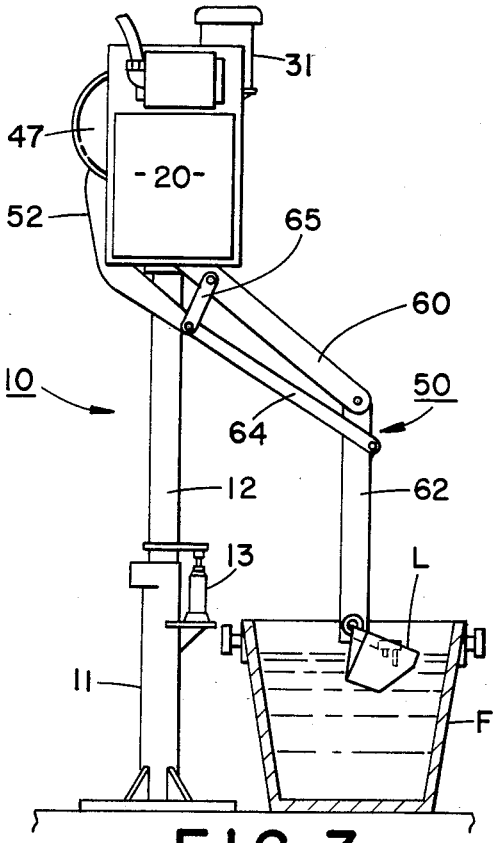
Figures 10, 13, 14:
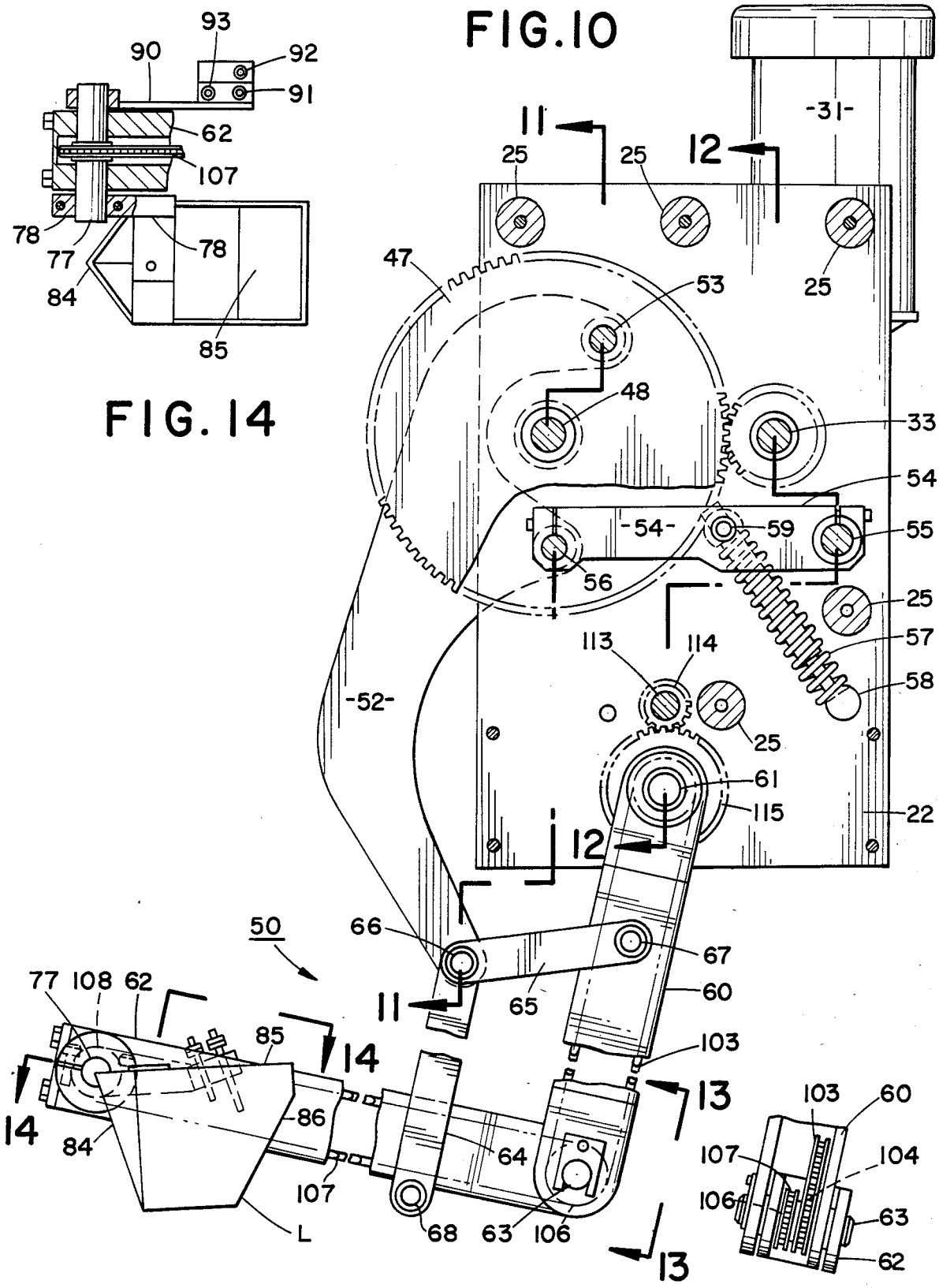
FIG. 10 is a broken elevational view on an enlarged scale, with parts broken away and shown in section for the purpose of illustration.
FIG. 13 is a fragmentary sectional view, taken on the line 13—13 of FIG. 10.
FIG. 14 is a fragmentary sectional view, taken on the line 14—14 of FIG. 10.
Figure 11:
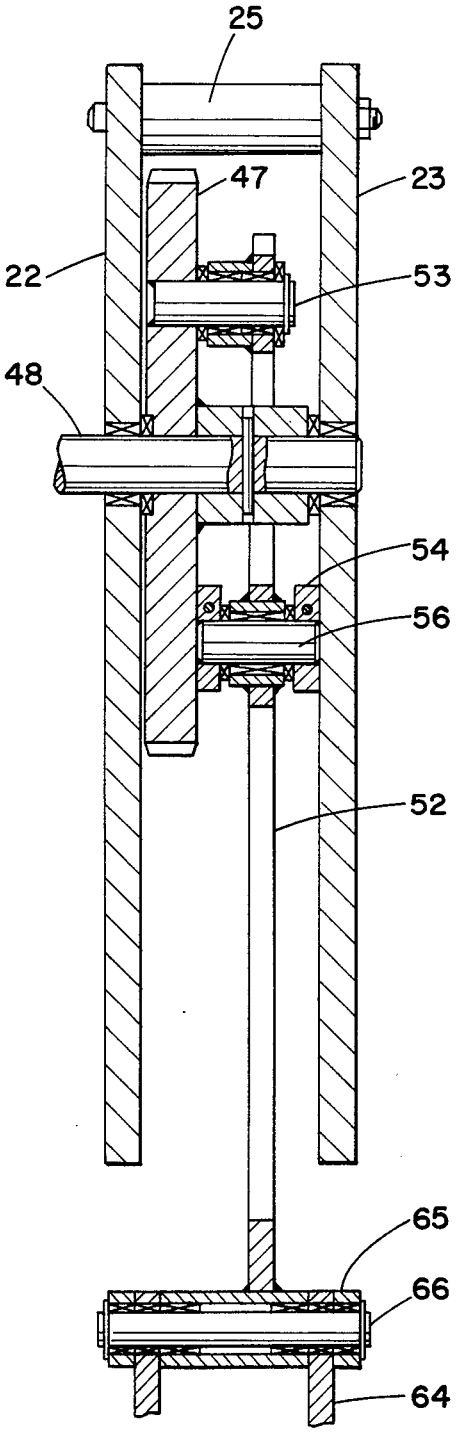
FIG. 11 is a fragmentary sectional view on an enlarged scale, taken on the line 11—11 of FIG. 10.
Figure 12:
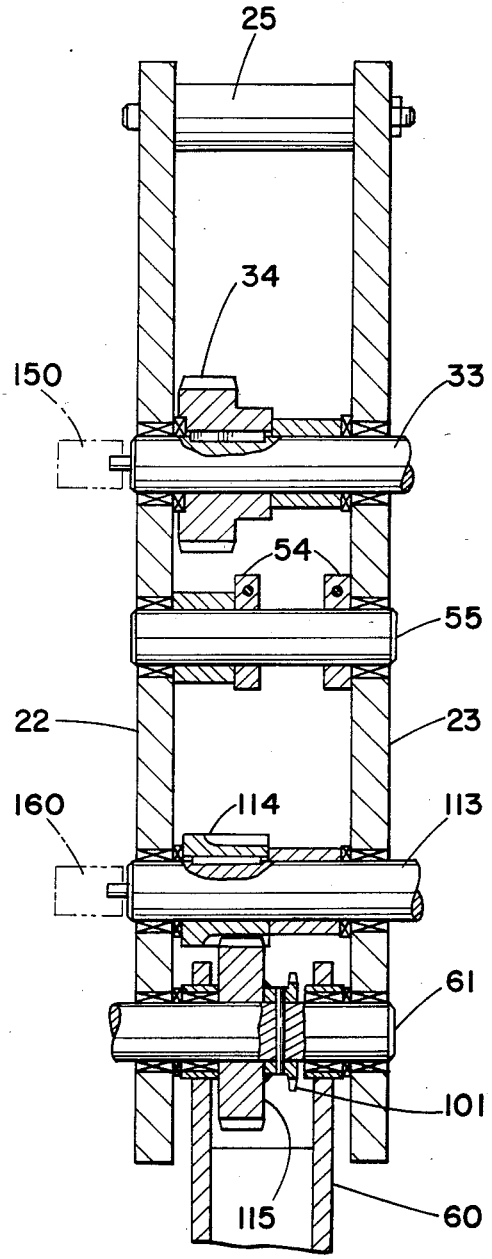
FIG. 12 is a fragmentary sectional view on an enlarged scale, taken on the line 12—12 of FIG. 10.

In order to control the ladle dipper attitude during transporting of molten metal, i.e., to maintain the ladle dipper in a level condition and also to tilt the ladle dipper slightly backwardly during the fill operation and forwardly during the pour operation, a ladle tilt assembly 100 is provided (FIG. 10) generally in association with the main link 60 and the carrier link 62. The ladle tilt assembly 100 includes a sprocket 101 (FIG. 12) keyed to the shaft 61. The sprocket 101 drives an endless roller chain 103 that extends from one end to the other of the main link 60 and drives another sprocket 104 secured to a sleeve 105 that is freely received over the pin 63 (FIGS. 3 and 10).

Another sprocket 106 is secured to the sleeve 105 coaxially with the sprocket 104, and is adapted to drive another endless roller chain 107 which extends the length of the carrier link 62 to another sprocket 108 (FIG. 12) secured to the shaft 77 of the ladle carriage assembly 70.

Accordingly, the tilting movement of the ladle dipper L is controlled by rotation of the sprocket 101 and shaft 61. Such control is important during the movement of the ladle dipper between its fill and pour positions because of the varying changes in attitude of the carrier link 62, which moves between a generally vertical position shown in dashed lines in FIG. 1 and in solid lines in FIG. 4, and a generally horizontal position shown in solid lines in FIGS. 1, 5, and 6.

It will be noted, however, that if the position of the sprocket 101 is held fixed during the movement of the main link 60 and carrier link 62, then the ladle dipper attitude will remain constant regardless of the angular position of the carrier link 62. On the other hand, any movement of the sprocket 101 will result in forward or backward tilting of the ladle dipper L.

The drive for the ladle tilt assembly 100 includes a reversible DC motor 111 and an associated warmtype gear reduction unit 112 with an output shaft 113. The shaft 113 has a pinion 114 that meshes with a gear 115 keyed to the shaft 61. Accordingly when the motor 111 is operated in its forward drive direction the ladle dipper L is tipped forwardly about the axis located at its spout to a pouring attitude. When the motor is operated in a reverse direction the ladle dipper is tilted about the axis in a reverse direction to return it to its normal attitude or to tilt it backwardly for filling.

Operation

Figure 7:
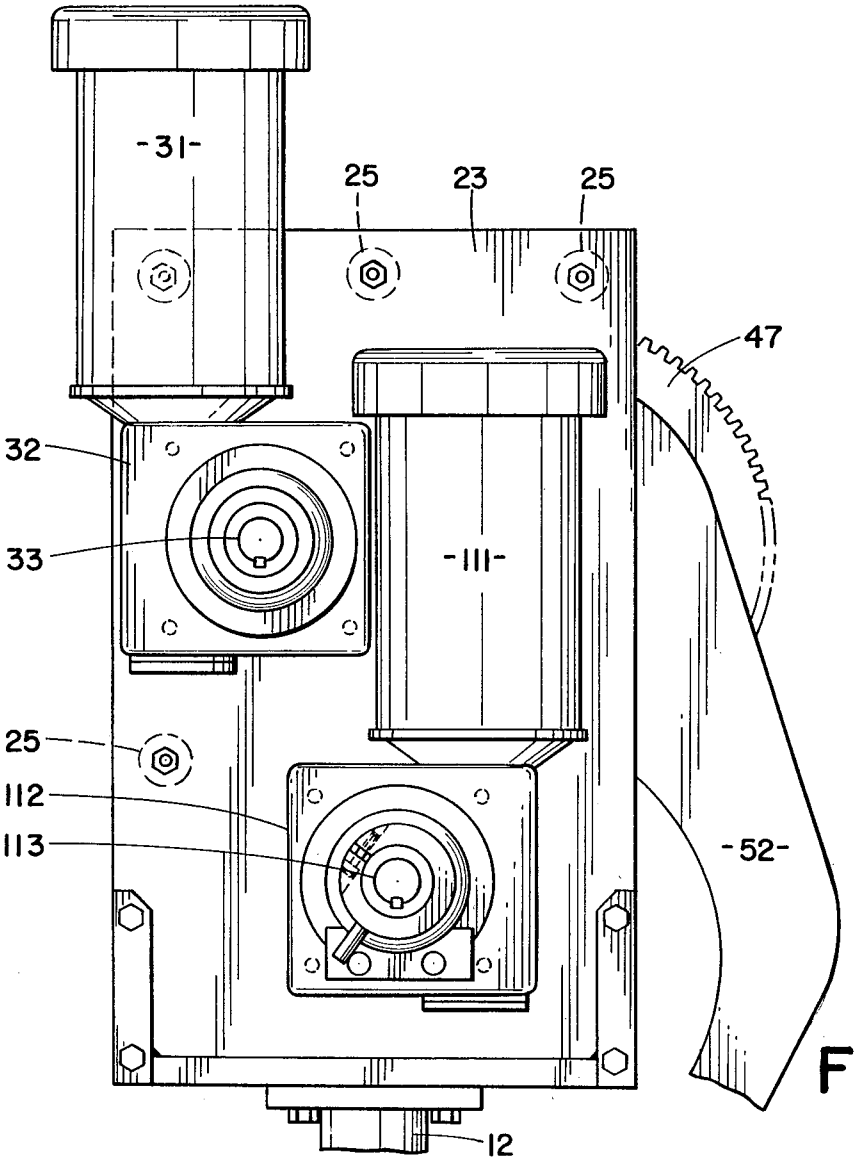
FIG. 7 is a fragmentary rear elevation on an enlarged scale of the apparatus of FIG. 1.

The operation of the apparatus is generally controlled by components that include encoders 150 and 160 operatively connected to the shafts 33 and 113, respectively, limit switches 151 and 153, operated by cams 152 and 154, respectively, carried on the outer end of the shaft 48, and a limit switch 156 operated by a cam 157 carried on the outer end of the shaft 61. The location of these components is best shown in FIG. 7. The limit switch 151 is actuated whenever the ladle dipper reaches a lower limit position in the furnace without having the probes 91 and 92 contact the molten metal. The switch 153 is actuated as the ladle dipper passes through its intermediate rest position to stop the movement of the ladle dipper when it is returning to its rest position. The switch 153 is also actuated as the ladle dipper passes through the intermediate rest position to start the abort-cycle timer that initiates a "not-ready-to-pour" abort sequence whenever certain ready-to-pour signals are not received from the die casting machine D. The switch 156 is actuated when the ladle dipper L is moved back to its level attitude.

Figure 4:
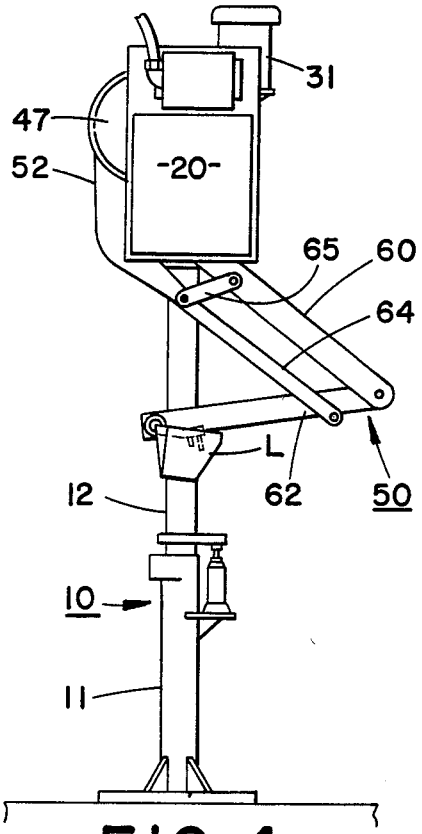

The automatic operating cycle of the apparatus is actuated by operating the motor 111 from a condition wherein the ladle dipper L is level and located at the intermediate rest position. The motor 111 operates in a reverse direction to tilt the ladle dipper backward to a fill attitude. The motor 31 then operates in its reverse direction at a predetermined selected speed to turn the drive gear 47 in a counter-clockwise direction so that the ladle transport assembly 50 retracts the ladle dipper L rearwardly and then in a downwardly curved path (FIG. 3) into the furnace F. The ladle dipper L will halt its downward movement when a metal level signal is sensed by the probes 91 and 92. At this point, a dipper fill timer is actuated for an interval in which the DC motor 31 is halted to permit the ladle dipper L to fill with molten metal (FIG. 4). If the level of the molten metal rises enough to touch the third probe 93, the ladle dipper will be raised until all of the probes are out of the metal. Then the motor 31 will be operated again to lower the ladle dipper until the probes touch and the dipper-fill timer will be actuated again.

After the dipper-fill timer times out, the motor 31 is operated in its forward position, and the ladle L is raised to a spill-off position determined by a preset pulse count from the encoder 150 and held there until the spill-off timer times out. This permits excess molten metal to drop back into the furnace. Then, the dipper motor 111 is operated in a forward direction until the dipper reaches a level attitude as determined by the limit switch 156.

When the spill-off timer times out, the motor 31 is operated in its forward direction again at a predetermined selected speed, and the ladle dipper L is moved forward (FIG. 5) through its intermediate rest position to the die casting machine D. As it passes the intermediate rest position, the limit switch 153 is actuated by the cam 157, and the "not-ready-to-pour" abort timer is initiated, and the ladle dipper moves forward (FIG. 6) at the predetermined selected ready-to-pour speed. Normally, the control system will receive a signal from the die casting machine indicating that the dies are locked in a closed position and the injection plunger is retracted. If these signals are not received by the time that the abort timer times out, the unit will go into a "pour-signal-not-received" abort cycle sequence. If the die-locked or plunger-retracted signals are broken while the ladle is pouring, the ladle dipper will stop and the abort cycle timer will be reinitiated.

When the ladle reaches its pouring position (FIG. 6) as determined by the encoder 150, the motor 31 is stopped. The ladle goes through several deceleration speeds prior to coming to a complete stop. Then the motor 111 is operated in the forward direction to tilt the ladle dipper forwardly to pour molten metal therefrom into the mold. A three-stage pouring process is employed. After the ladle dipper moves a predetermined selected distance as determined by the encoder 160, the motor 111 continues to move the ladle dipper forwardly at a different speed. Three such different speeds are employed. When pouring is complete, the dipper motor 111 is operated in a reverse direction until the dipper is level as indicated by the limit switch 156, and the motor 31 is operated in a reverse direction so that the unit will start retracting at the auto-return speed until the unit reaches its intermediate rest position as determined by the limit switch 153.

If the pour-signal-not-received abort-cycle timer times out, the abort cycle begins. The ladle dipper L will start retracting at a predetermined speed until it has returned to the furnace and the probes 91 and 92 touch the molten metal. Then the molten metal will be poured back into the furnace by operating the motor 111 in a forward direction employing the three-stage pouring process already described. When this is done, the dipper will return to its level attitude and it will be moved back to the intermediate rest position as indicated by the limit switch 153, and the unit will await the next cycle-start signal.

Control System

With reference to FIG. 7, the basic component of the control system for the apparatus A include an encoder 150 on the shaft 33, a limit switch 151 operated by a cam 152 carried on the outer end of the shaft 48, a limit switch 153 operated by a cam 154 carried on the outer end of the shaft 48, a limit switch 156 operated by a cam 157 carried on the outer end of the shaft 61, and an encoder 160 on the shaft 113.

The limit switch 151 is actuated whenever the ladle dipper reaches a lower limit position in the furnace. The limit switch 153 is actuated when the ladle dipper is positioned in its intermediate rest position. The limit switch 156 is actuated when the ladle dipper L returns to its level attitude.

Figure 15:
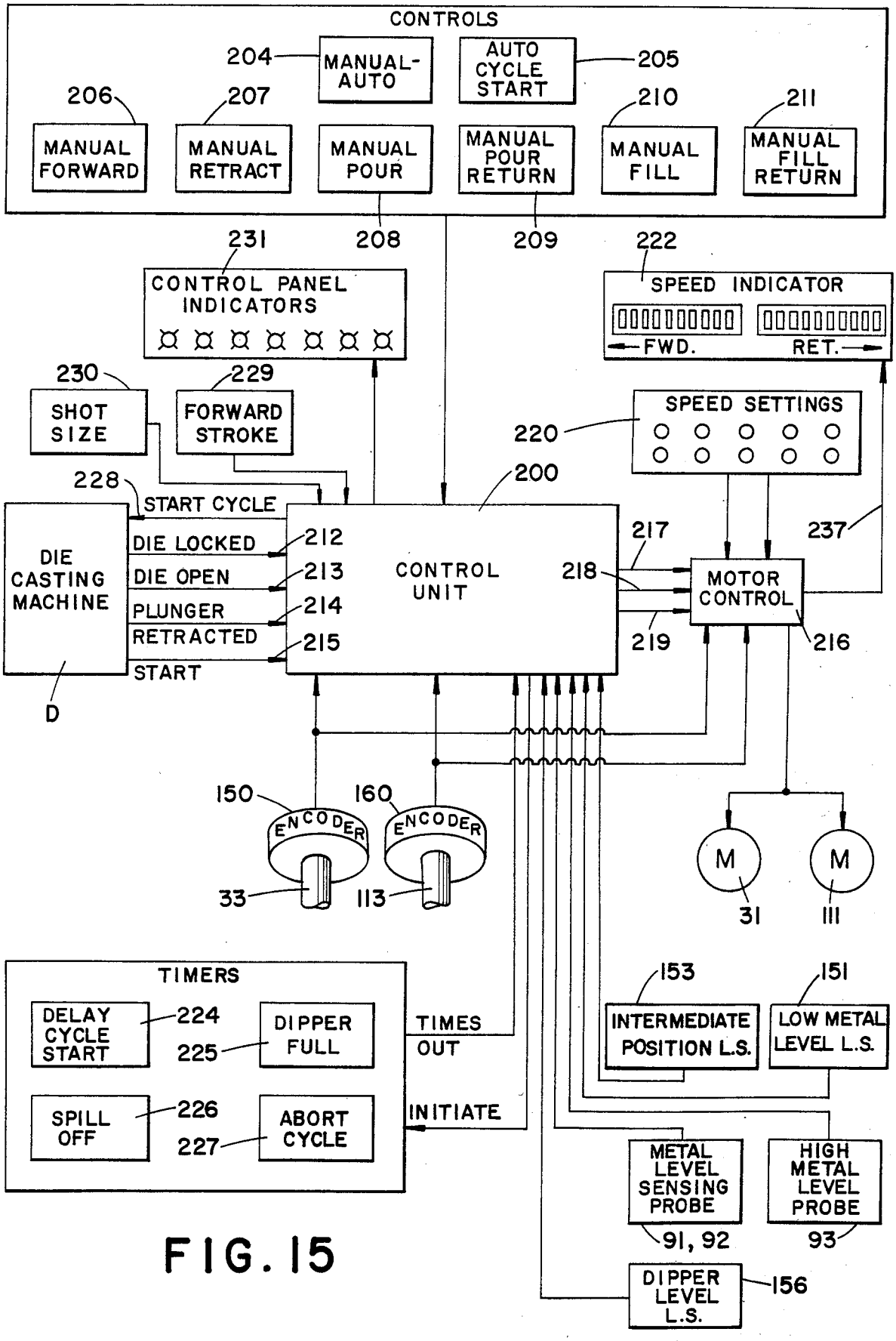
FIG. 15 is a schematic block diagram of a control system of the invention.

As shown in FIG. 15, the limit switches 151, 153 and 156, along with the metal level sensing probes 91, 92, and 93, are connected to a control unit 200 which controls the operation of the apparatus A. The control unit 200 is also connected to the encoders 150 and 160. The control unit 200 operates in accordance with input control signals supplied from control switches 204–211. The control unit 200 also receives interlock signals from the die casting machine D on lines 212–215. In accordance with these input signals, the control unit operates the apparatus A by controlling the operation of the motors 31 and 111 through a motor control circuit 216.

The control unit 200 is connected to the motor control circuit 216 by means of three lines 217, 218 and 219. The line 217 is a three-bit line which supplies the motor control circuit 216 with data indicating at which of seven preadjusted speeds the drive motor 31 should be operated. The line 218 is a three-bit line which supplies the motor control circuit 216 with data indicating at which of seven preadjusted speeds the dipper motor 111 should be operated. The line 219 is a two-bit line which indicates which of the motors 31 or 111 should be operated at any time. In accordance with the signals on the lines 217, 218 and 219, the motor control circuit 216 selects one of the seven drive motor speeds and one of the seven dipper motor speeds and supplies the appropriate speed to the appropriate motor in accordance with the signal on the line 219. The various speeds of the motors 31 and 113 are preset by the speed control settings 220. The selected speed of the motor 31 is also fed to a speed indicator display 222.

The three-bit line 217 is capable of providing a signal designating one of seven different main motor speed indications to the motor control circuit 216. These seven speed signals are represented in the following table:

TABLE 1

MAIN MOTOR SPEEDS

| Three-Bit Signal (Line 217) | Speed | Description | Fixed or Adjustable | Movement Direction |
|---|---|---|---|---|
| 000 | Stop | No movement | Fixed | — |
| 001 | A | Retract-to-Metal Speed | Adjustable | Retract |
| 010 | B | Dipper Fill (and Abort) | Fixed | Forward |

TABLE 1-continued

MAIN MOTOR SPEEDS

| Three-Bit Signal (Line 217) | Speed | Description | Fixed or Adjustable | Movement Direction |
|---|---|---|---|---|
| 011 | C | Speed Forward-to-Pour Speed | Adjustable | Forward |
| 100 | D | First Deceleration | Fixed | Forward |
| 101 | E | Second Deceleration | Fixed | Forward |
| 110 | F | Auto Return Speed | Fixed | Retract |

The three-bit line 218 is capable of providing a signal designating one of seven different dipper tilt motor speed indications to the motor control circuit 216. These seven dipper motor speed signals are represented in the following table:

TABLE 2

DIPPER MOTOR SPEEDS

| Three-Bit Signal (Line 218) | Speed | Description | Fixed or Adjustable | Tilt Direction |
|---|---|---|---|---|
| 000 | Stop | No movement | Fixed | — |
| 001 | H | Fill Speed | Adjustable | Back |
| 010 | I | Fill Return Speed | Fixed | Forward |
| 011 | J | First Pour Speed | Adjustable | Forward |
| 100 | K | Second Pour Speed | Adjustable | Forward |
| 101 | L | Third Pour Speed | Adjustable | Forward |
| 110 | M | Pour Return Speed | Fixed | Back |

The two-bit line 219 is capable of providing a signal designating which of the motors 31 and 111 is to be operated. This signal is represented in the following table:

TABLE 3

MOTOR SELECTIONS

| Two-Bit Signal (Line 219) | Motor Selected |
|---|---|
| 00 | Neither Motor |
| 01 | Main Motor |
| 10 | Dipper Motor |

The control unit 200 monitors the position of the ladle transport assembly and receives signals indicating that the transport assembly is at one of various programmable positions. These positions are determined using the encoders 150 and 160. As each position is desired, a binary number which is stored in a memory in the control unit 200 is fed into a counter in the control unit. The counter then counts down to zero as it is pulsed either by the encoder 150 as the shaft 33 rotates or by the encoder 160 as the shaft 113 rotates. The output of the counter is fed to a comparator which compares the counter output to zero. When the output of the counter is equal to zero, the comparator sends a signal indicating that the desired position has been reached. This signal is then used by other portions of the control unit 200 to control the movement of the ladle transport assembly.

In the preferred form of the invention, there are two positions of the ladle transport assembly and four attitudes of the ladle dipper which are controlled by the encoders 150 and 160. These positions and attitudes are programmable, and the determination of the location of each position or attitude depends upon the count provided to the counter to which the encoder signals are sent. In the preferred form of the present invention, the two positions of the ladle transport assembly are:

(a) Spill-Off Position. This is the position at which the ladle dipper begins spill-off at the furnace F after it has been filled, and at which a spill-off timer is initiated. The count fed to the counter represents the distance from the metal level to the position above the metal level at which spill-off occurs.

(b) First Deceleration Position. This is the position at which the ladle transport assembly switches from the forward-to-pour speed to the first deceleration speed as it approaches the furnace. The count fed to the counter represents the distance from the intermediate rest position to the position at which the ladle transport assembly begins slowing down, and it may be calculated by subtracting a certain number of encoder pulses from the selected forward stroke position.

(c) Second Deceleration Position. This is the position at which the ladle transport assembly switches from the first deceleration speed to the second deceleration speed. The count fed to the counter represents a predetermined distance from the first deceleration position.

(d) Ready-To-Pour Position. This is the forward most position of the ladle dipper at which the dipper begins to tilt to pour molten metal into the die casting machine. The count fed to the counter represents a predetermined distance from the second deceleration position to the position above the die casting machine at which pouring begins.

In the preferred form of the present invention, the four attitudes of the ladle dipper are:

(e) Fill Attitude. This is the rearwardly tilted attitude of the ladle dipper used to fill the ladle dipper when it is in the furnace F. The count fed to the counter represents the amount of rearward tilt desired to fill the ladle. This attitude is controllable by the operator in order to control the shot size, i.e., the amount of molten metal being transported from the furnace to the die casting machine.

(f) Pour Attitude No. 1. This is the attitude at which the ladle dipper switches from the first pour speed to the second pour speed. The count fed to the counter represents the distance from the level attitude of the dipper at which the dipper transports the molten metal to the die casting machine and begins to pour.

(g) Pour Position No. 2. This is the attitude at which the ladle dipper switches from the second pour speed to the third pour speed. The count fed to the counter represents the distance from the pour attitude No. 1.

(h) Pour Position No. 3. This is the attitude at which the ladle dipper finishes pouring. The count fed to the counter represents the distance from the pour attitude No. 2. This attitude is the fully forwardly tilted attitude of the ladle dipper.

During the operation of the apparatus A, certain steps are delayed, and therefore the control unit 200 is connected to a plurality of adjustable timers 224–227. A delay-cycle-start timer 224 delays the beginning of the automatic cycle after the start cycle interlock is given. A dipper-fill timer 225 halts motion of the ladle dipper in the furnace so that the dipper may fill. A spill-off timer 226 delays motion of the dipper after it fills and while it is over the furnace F so that excess metal may spill off back into the furnace. And an abortcycle timer 227 is used to delay the initiation of the abort cycle to give the die casting machine D adequate time to be prepared for the introduction of the metal. Each of these timers 224–227 is adjustable, so that each of the delay times may be varied.

The control unit 200 is also capable of verifying operation of the die casting machine D by sending an appropriate signal on a line 228. The control unit 200 verifies that the ladle cycle should start by sending a return signal on the line 215. The control unit 200 is also connected to a forward-stroke setting 229 by which the ready-to-pour position may be adjusted, and to a shot-size setting 230 by which the rearward fill till attitude of the ladle dipper may be controlled to control the amount of molten metal being transported by the ladle assembly. Operation of the apparatus A is monitored by various control panel indicators 231, which are also operated by the control unit 200.

The control unit 200 may comprise any suitable control circuitry capable of carrying out a predetermined program of operations in accordance with various conditional inputs. In one form of the present invention, the control unit 200 comprises a circuit of TTL components in which the signal for each step of the operations is conditional upon the completion of a previous step. Such a control unit has the advantage in that an easy step-by-step movement can be obtained for ease of understanding and trouble shooting. In addition, a stepwise control system provides for noise immunity. This is achieved by making the enable for a step come from the output of a preceding step. If there is noise on an input to a step, that step will not be initiated unless the preceding step has already been accomplished.

Alternatively, the control unit 200 may comprise a microprocessor or other unit capable of performing a sequence of operations from a predetermined program. For example, the program may be contained in a read-only memory which drives a multiplexer unit to provide the necessary signals.

The control switches 204–211 include a manualauto selector switch 204 through which the operator selects between manual and automatic operation of the apparatus A. If automatic operation is selected, the operator initiates the operation by actuating the auto-cycle-start switch 205 or operation may be initiated through the die casting machine D sending a start cycle interlock input on the line 215 in response to a signal on the line 212. If manual operation is selected, the operator controls the movement of the ladle transport assembly using the manual control switches 206–211. The manual forward switch 206 moves the ladle transport assembly forward, and the manual retract switch 207 moves the transport assembly back. The manual pour switch 208 is used to cause the ladle dipper to tilt forward and pour the metal into the die casting machine D when the transport assembly is at the ready-to-pour position. The manual pour return switch 209 is used to cause the ladle dipper to return to its level attitude after pouring. The manual fill switch 210 is used to tilt the ladle dipper to its rearward attitude for filling molten metal in the furnace F. The manual fill return switch 211 is used to return the ladle dipper D to its level attitude after it has been tilted rearwardly for a fill.

The details of the motor control circuit 216 may be seen with reference to FIGS. 16–19. As shown in FIG.

16, the three-bit line 217 from the control unit 200 is fed to a binary-to-decimal decoder 232. The b/d decoder 232 may be, for example, an SN7445 integrated circuit unit manufactured by Texas Instruments, Inc., which is a TTL circuit, and is thus compatible with the TTL logic employed in the control unit 200. The b/d decoder 232 provides seven outputs which are used as control inputs for an array of analog switches 233.

The array of analog switches 233 selectively connects either ground or one of the motor speed control settings supplied on lines 234A–F to a line 235. The array of analog switches 233 may be, for example, a pair of AD7501 multiple analog switch units manufactured by Analog Devices. The line 235 is connected to the positive input of a unity-gain voltage follower amplifier 236 having a feedback loop in which the output is connected to the negative input of the amplifier. The output of the amplifier 236 is fed on a line 237.

The motor speed control settings supplied on the lines 234A–F correspond to the main motor speeds shown in Table 1. The line 234A is connected to the output of a potentiometer 239 which is connected the negative supply voltage and ground. By adjusting the potentiometer 239, an adjustable retracting speed can be selected. The line 234B is connected to a fixed voltage takeoff between series resistors 240 and 241. The resistors 240 and 241 are connected in series between the positive supply voltage and ground. The voltage on the line 234B corresponds to a fixed forward motor speed. The line 234C is connected to the output of a potentiometer 242 which is connected between a positive supply voltage and ground.

The lines 234D and 234E supply the two deceleration speeds for forward movement of the ladle transport assembly as it approaches the ready-to-pour position. The two deceleration speeds are adjustable by means of a potentiometer 244 which is connected between a positive supply voltage and ground. The output of the potentiometer 244 is supplied to a unity-gain voltage follower amplifier 245 having a feed back loop in which the output is connected to the negative input of the amplifier. The output of the amplifier 245 is supplied to two voltage take-offs comprising series resistors 246 and 247 and series resistors 248 and 249. The line 234D is connected between the resistors 246 and 247 and the line 234E is connected between the resistors 248 and 249. The value of the resistors 246 and 247 is such that the voltage fed on the line 234D is approximately equal 70% of the voltage provided from the output of the amplifier 245. The value of the resistors 248 and 249 is such that the voltage on the line 234E is approximately 30% of the output of the amplifier 245. By adjusting the potentiometer 244 to match the adjustable forward-to-pour speed on the line 234C as set by the potentiometer 242, the deceleration speeds as determined by the voltages on the line 234D and 234E are equal to approximately 70% and 30%, respectively, of the full forward speed.

The line 234F is connected to the output of a potentiometer 251 which is connected between the negative supply voltage and ground.

Figure 17:
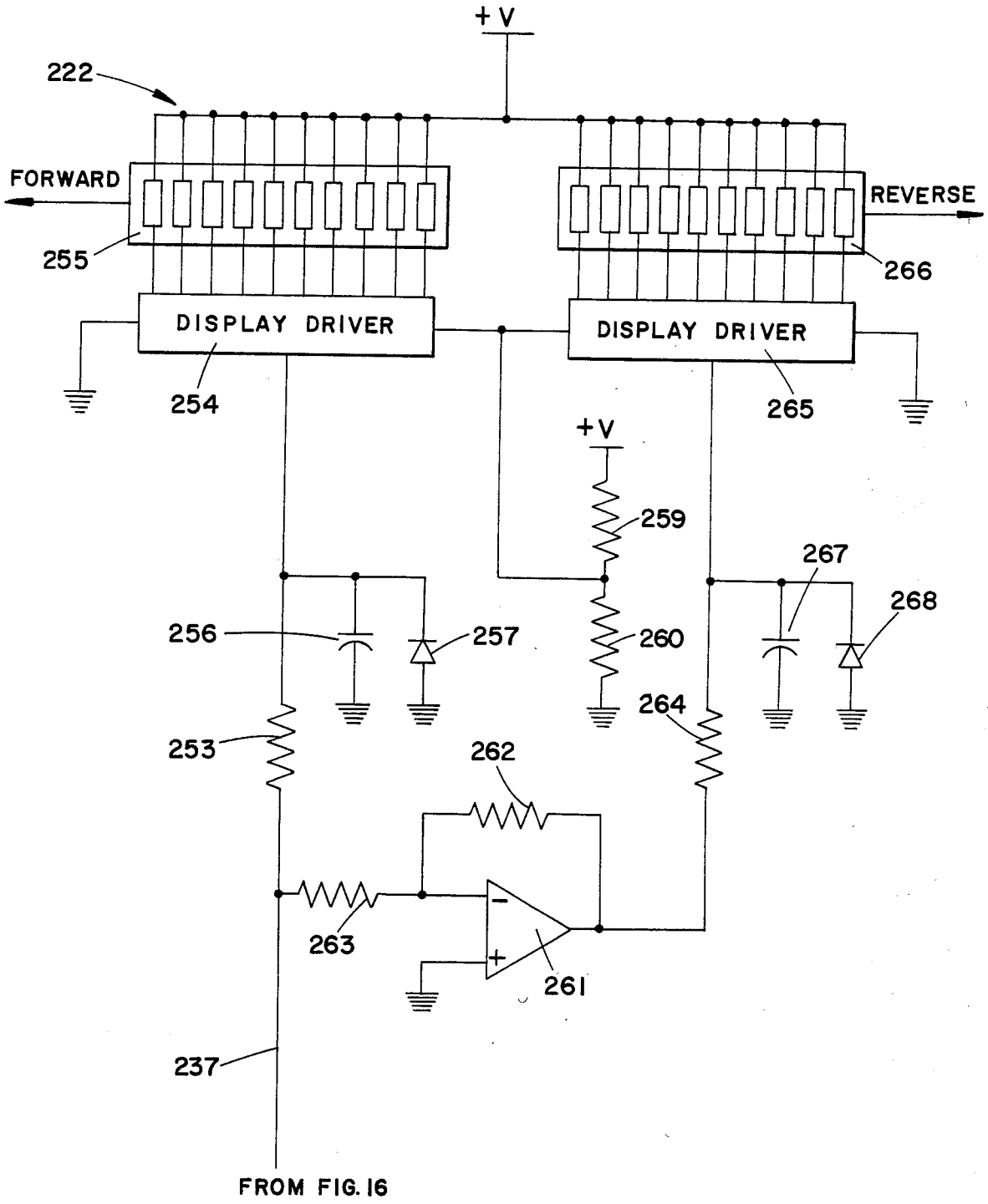
FIG. 17 is a schematic diagram of a portion of FIGS. 18 and 19 showing speed control settings.

The output of the amplifier 236 is fed on the line 237 to the speed indicator display 222 shown in FIG. 17. The output of the line 237 is fed through a resistor 253 to a bar graph display driver 254. The display driver 254 is connected to a display 255 comprising an array of LED bars. The display 255 may be, for example, an MF57164 unit manufactured by General Instruments, which is comprises a 10-bar LED display. The display driver 254 may be, for example, an LM3914 integrated circuit unit manufactured by National Semiconductors, which supplies ten outputs to the display 255. The LM 3914 unit provides a linear display whereby one of the ten LED's is illuminated for each tenth of full-scale voltage fed to the display driver. Alternatively, the display driver 254 may be an LM3915 unit, also manufactured by National Semiconductors, which provides for a logrithmic in the bar graph display 255 instead of a linear display. The input of the display driver 254 is grounded through a capacitor 256 to delay the rise and fall of the display and is grounded through a biasing diode 257 to prevent negative voltage levels from being fed to the display driver 254. The display driver 254 is connected to a calibration setting by being connected between series resistors 259 and 260 which provide a reference voltage to the display drivers at which a full scale indication will be displayed.

The display 255 only operates when the voltage on the line 237 is positive. A substantially identical circuit is provided for displaying negative voltage levels on the line 237. This display is fed by the output of a unity-gain inverting amplifier 261. The amplifier 261 has the positive input grounded and the negative input connected to a feedback loop having a feedback resistor 262. An input resistor 263 is connected between the line 237 and the negative input of the inverting amplifier 261. The resistors 262 and 263 are equal in value so that the inverting amplifier 261 has a gain of one. The output of the amplifier 261 is fed through a resistor 264 to a display driver 265. The resistor 264 is identical to the resistor 253 and the display driver 265 is identical to the display driver 254. The display driver 265 operates a bar display 266 which is essentially identical to the display 255, but which is mounted in the opposite direction. The input of the display driver 265 has a capacitor 267 and a diode 268 which are identical in operation to the capacitor 256 and the diode 257.

Figure 18:
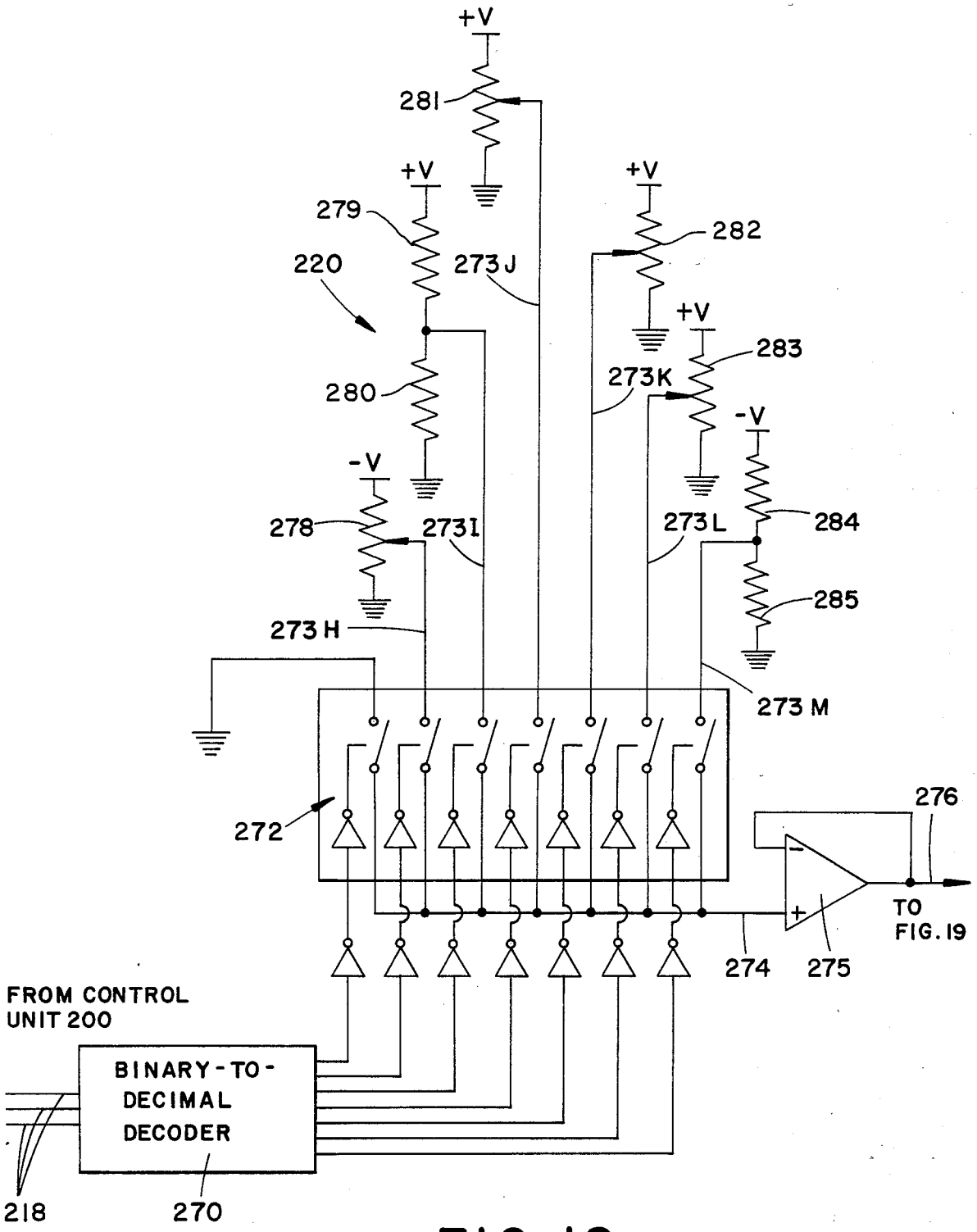

The three-bit line 218 from the control unit 200 is used to control the speed of the dipper motor using the portion of the motor control circuit shown in FIG. 18. The three-bit line 218 is fed from the control unit 200 to a binary-to-decimal decoder 270. The b/d decoder 270 may be substantially identical to the b/d decoder 232 shown in FIG. 16, and may be, for example, an SN7445 integrated circuit unit manufactured by Texas Instruments, Inc., which is also a TTL circuit. The b/d decoder 270 provides seven outputs which are used as control inputs for an array of analog switches 272. The array of analog switches 272 selectively connects either ground or one of the six dipper motor speed control settings supplied on lines 273H–M to a line 274. The array of analog switches 272 may be substantially identical to the analog switch array 233 shown in FIG. 16, and may be, for example, a pair of AD7501 multiple analog switch units manufactured by Analog Devices. The line 274 is connected to the positive input of a unity-gain voltage follower amplifier 275 having a feedback loop in which the output is connected to the negative input of the amplifier. The output of the amplifier 275 is fed on a line 276.

Figure 16:
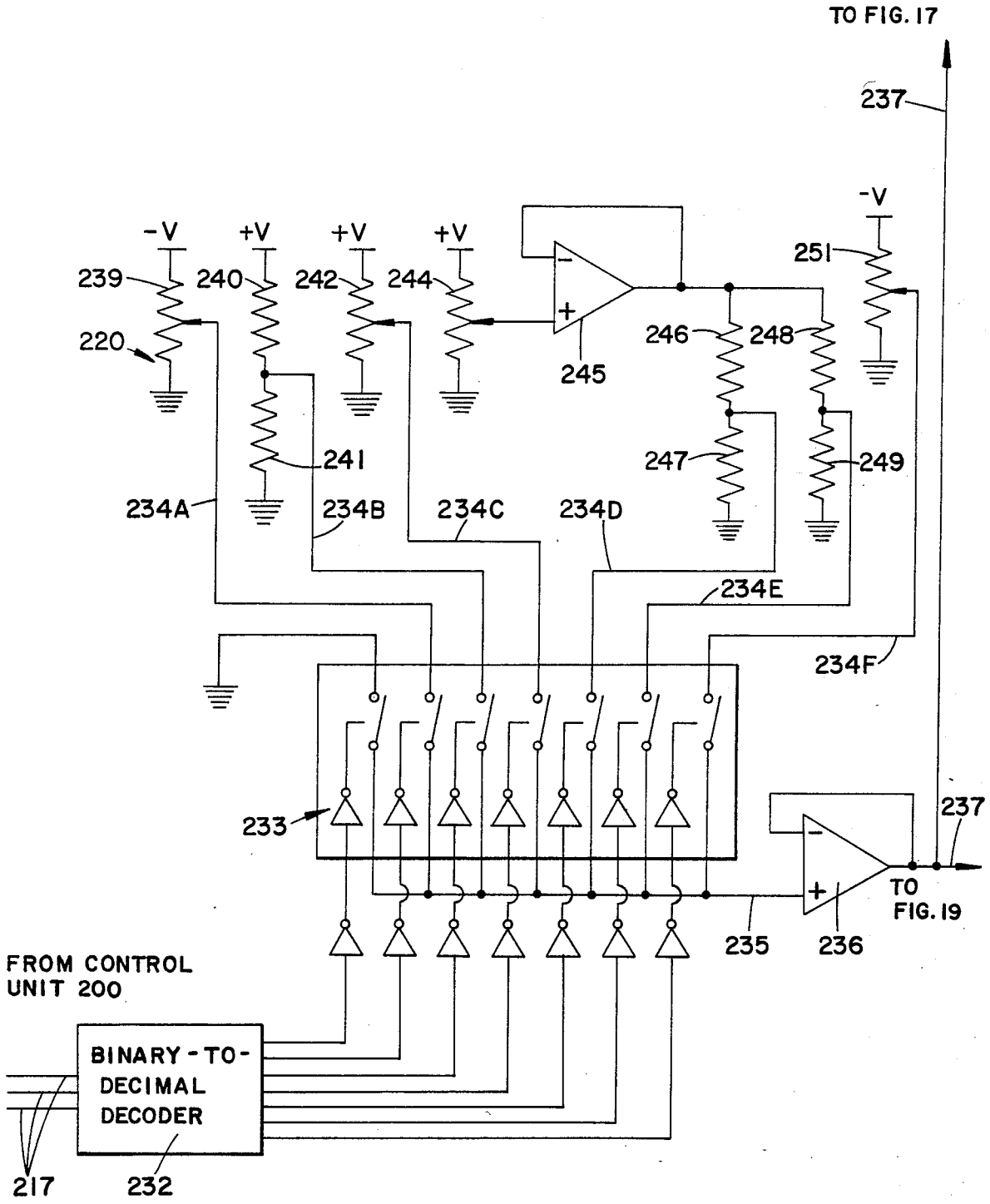
FIG. 16 is a schematic diagram of a portion of FIG. 18 showing the motor control circuit.

The dipper motor speed settings utilize fixed voltage take-offs and potentiometers similar to those shown in FIG. 16 for the main motor speed control settings. These provide the dipper motor speeds corresponding to those shown previously in Table 2. The line 273H is connected to the output of a potentiometer 278 which is connected between the negative supply voltage and ground. The line 273I is connected between series resistors 279 and 280 which are connected between the positive supply voltage and ground to supply a fixed voltage on the line 273I. The lines 273J–L which supply the three forward speeds are connected to potentiometers 281, 282 and 283, respectively, each of which is connected between the positive supply voltage and ground. The line 273M is connected between series resistors 284 and 285 which are connected between the negative supply voltage and ground.

Figure 19:
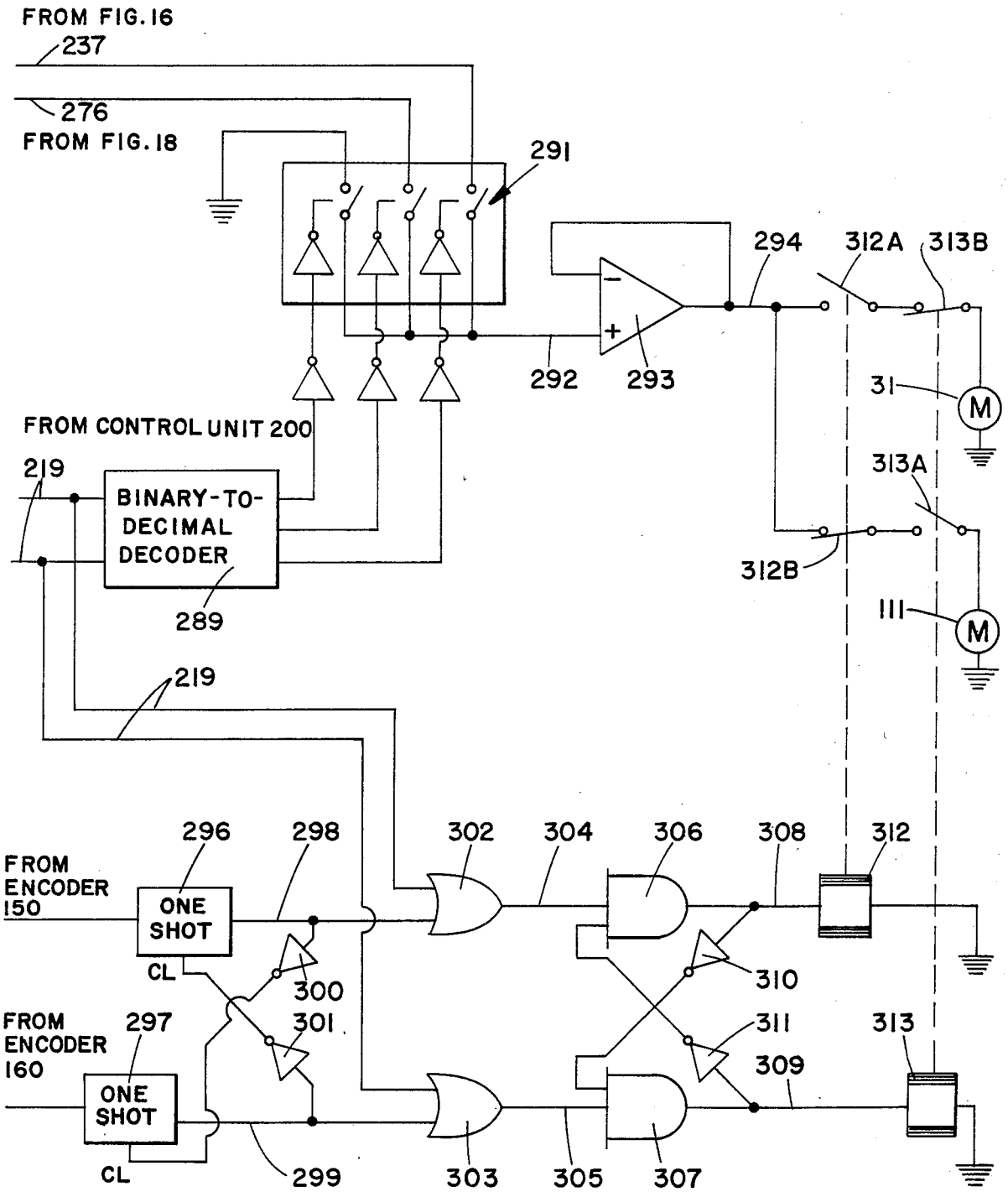

The selected main motor speed control setting on the line 237 and the selected dipper motor speed control setting on the line 276 are selectively fed to the respective motor according to the signal on the line 219 fed from the control unit 200 to the motor control circuit 216. As shown in FIG. 19, the two-bit line 219 from the control unit 200 is fed to a binary-to-decimal decoder 289. The b/d decoder may be substantially identical to the decoders 232 in FIG. 16 and 270 in FIG. 18. The b/d decoder provide three outputs which are used as control inputs for an array of analog switches 291. The array of analog switches 291 selectively connects either ground or one of the motor speed control settings supplied on the line 237 or on the line 276 to a line 292. The array of analog switches 291, may be substantially the same as those used for the analog switch array 233 in FIG. 16 and the analog switch array 272 in FIG. 18. The line 292 is connected to the positive input of a unity-gain voltage follower amplifier 293 having a feedback loop in which the output is connected to the negative input of the amplifier. The output of the amplifier 293 is fed to the drive motor 31 and to the dipper motor 111 on a line 294.

The output from the main drive encoder 150 and the output from the dipper encoder 160 are fed to a pair of retriggerable one-shots 296 and 297, respectively. The output of each of the one-shots 296 and 297 is supplied on a line 298 and 299, respectively. The output of the one-shot 296 on the line 298 is inverted using an inverter 300 and supplied to the "clear" input of the one-shot 297. Likewise, the output of the one-shot 297 supplied on the line 299 is inverted by an inverter 301 and supplied to the "clear" input of the one-shot 296.

Thus, when the main motor 31 is running and a series of pulses is received from the main drive encoder 150 to the one-shot 296, a high level output is supplied on the line 298. This high level output is inverted using the inverter 300 to a low level "clear" signal to the one-shot 297 so that a low level output is supplied on the line 299. This low level output on the line 299 is inverted using the inverter 301 to supply a high level non-enabling "clear" input to the one-shot 296. Likewise, when the dipper motor 111 is operating and a series of pulses is received from the dipper encoder 160 to the one-shot 297, a high level output is supplied on the line 299 which is inverted using the inverter 301 to provide a low level "clear" signal to the one-shot 296 to assure that a low level output is provided on the line 298.

The output of the one-shot 296 on the line 298 is fed an OR gate 302, the other input of which is one half of the two-bit motor control signal on the line 219. The output of the one-shot 297 as supplied on the line 299 is fed to a corresponding OR gate 303, the other input of which is the other half of the two-bit signal on the line 219. The output of the OR gate 302 is supplied on a line 304, and the output of the OR gate 303 is supplied on a line 305. The line 304 will contain a high level signal either when the main motor 31 is operating, as indicated by a series of pulses from the encoder 150 fed through the one-shot 296 to supply a high level output on the line 298, or when the main motor is selected according to the signal on the line 219. The line 305 will contain a high level signal either when the dipper motor 111 is operating, as indicated by a series of pulses from the dipper encoder 160 fed through the one-shot 297 to produce a high level signal on the line 299, or when the motor selection signal on the line 219 indicates the selection of the dipper motor.

To assure that both the main motor 31 and the dipper motor 111 are not operating at the same time, the output of the lines 304 and 305 is fed to a latching arrangement comprising AND gates 306 and 307. The line 304 provides one of the inputs to the AND gate 306, and the line 305 provides one of the inputs to the AND gate 307. The output of the AND gate 306 is supplied on a line 308, and the output of the AND gate 307 is supplied on a line 309. The output of the AND gate 306 on the line 308 is fed through an inverter 310 to supply the other input of the AND gate 307, and the output of the AND gate 307 on the line 309 is supplied through a corresponding inverter 311 to provide the other input of the AND gate 306. The latching arrangement of the AND gates 306 and 307 with the inverted output of each AND gate supplying one of the inputs to the other AND gate assures that the lines 308 and 309 will not have high level outputs at the same time.

The line 308 is connected to a relay coil 312 which controls the operation of the main motor 31. The line 309 is connected to a relay coil 313 which controls the operation of the dipper motor 131. The relay coil 312 operates a normally open relay contact 312A located on the line 294 between the output of the amplifier 293 and the drive motor 31, and it operates a normally closed relay contact 312B located on the line 294 between the output of the amplifier 293 and the dipper motor 111. The relay coil 313 operates a normally open relay contact 313A located on the line 294 between the output of the amplifier 293 and the dipper motor 111, and it operates a normally closed relay contact 313B located on the line 294 between the output of the amplifier 293 and the main drive motor 31.

Thus, when the line 308 has a high level signal and the relay coil 312 is energized, the normally open relay contact 312 is closed to supply the selected speed control setting on the line 294 to the main drive motor 31. At the same time, the relay contacts 313A and 312B are both open so that the dipper motor 111 is disabled. When the line 309 has a high level signal, the relay coil 313 is energized closing the relay contact 313A and opening the contact 313B, so that the selected speed control setting on the line 294 is supplied to the dipper motor 111 and the main drive motor 31 is disabled. Since the lines 308 and 309 cannot both have high level signals at the same time due to the latching arrangement provided by the AND gates 306 and 307, the relay coils 312 and 313 cannot both be energized at the same time. In addition, since there is a series arrangement of relay contacts between the output of the amplifier 293 and either the drive motor 31 or the dipper motor 111, each of the contacts being operated by one of the relay coils 312 or 313, the drive motors 31 and the dipper motor 111 cannot be operated at the same time.

The motors 31 and 111 run from the power supply connected to the potentiometers 239, 242, 244, 251, 278, 281, 282, 283, and 284 and series resistors 240, 241, 279, 280, 284 and 285. These potentiometers and series resistors operate from either a positive voltage supply or a negative voltage supply. This voltage supply is typically either +15 volts or −15 volts. The amplifiers 236, 248, 275 and 293 also run from this power supply. The other portions of the control unit are preferably TTL or TTL-compatible and run from a +5-volt power supply. This +5-volt power supply is preferably optically isolated from the 15-volt power supply which runs the motors 31 and 111 so that any interference produced by the motors will not effect the other components of the control system.

Manual Operation

The apparatus A may be operated in either a manual mode or an automatic mode. In the manual mode of operation, the manual-auto select switch 204 is set to "manual", and the control unit 200 operates in accordance with this setting. To begin manual operation, the first step is to fill the dipper L. The operator depresses the manual fill switch 210. In response to the actuation of this switch 210, the control unit supplies a signal on the lines 218 and 219 indicating the operation of the dipper motor 111 at the dipper fill speed H. The dipper motor 111 will operate to tilt the ladle dipper rearwardly under the control of the encoder 160 until the dipper tilt reaches the desired attitude as input by the shot size input 230. The operator then depresses the manual retract switch 207. In response to the actuation of this switch 207, the control unit 200 supplies a signal on the lines 217 and 219 indicating the operation of the main motor 31 at the retract-to-metal speed A. The ladle transport assembly will retract until the sensing probes 91 and 92 touch the metal in the furnace F or until the low-metal-level limit switch 151 is made. Either one of these signals will stop the transport assembly from retracting. The control unit 200 stops retraction by sending a 000 signal on line 217 indicating no movement.

Once the dipper has had sufficient time to fill, the operator actuates the manual forward switch 206, the control unit 200 supplies signals on the lines 217 and 219 indicating operation of the main motor 31, and the ladle transport assembly moves forward to a spill-off position. When the dipper reaches the spill-off position, the operator depresses the manual fill return switch 211. This causes the control unit 200 to supply signals on the lines 218 and 219 indicating the operation of the dipper motor 111 at the fill return speed I. The dipper motor 111 operates until the dipper level limit switch 156 indicates that the dipper has reached a level transport attitude at which time a 000 signal is fed on the line 218 to stop the dipper motor 111.

The operator then actuates the manual forward switch 206. The control unit 200 supplies a signal on the lines 217 and 219 indicating operation of the main motor 31 at the forward-to-pour speed C, and the ladle transport assembly moves forward until it actuates the intermediate position limit switch 153. The ladle transport assembly continues to move forward past the intermediate position limit switch actuation point until it approaches a ready-to-pour position as selected by the forward stroke input 229. At this point, the control unit 200 automatically changes the speed of the motor control unit 216 to the first deceleration speed D. The ladle transport assembly continues to move forward a predetermined distance at which time the control unit 200 changes to the second deceleration speed E. The control unit moves forward an additional predetermined distance as measured by the main encoder 150 until it reaches the ready-to-pour position at which time, the control unit 200 stops further movement of the ladle transport assembly.

To pour the metal into the die casting machine D from the ladle dipper, the operator actuates the manual pour switch 208. The control unit 200 checks to see that the dies are closed and locked and that the plunger is retracted in the die casting machine D. These signals are provided from the die casting machine D to the control unit 200 on the lines 212, 213 and 214. The control unit 200 will then send signals on the lines 218 and 219 to cause the ladle dipper motor 111 to operate at the first pour speed J until the ladle dipper reaches the first pour attitude. The first pour attitude is a programmable position and is determined by the signal received from the dipper encoder 160. After the ladle dipper reaches the first pour attitude, the control unit automatically switches to the second pour speed K by providing the appropriate signal on the line 218. The ladle dipper will tilt forward at this speed until it reaches the second pour attitude as indicated by the encoder 160. At this time, the control unit 200 automatically changes the speed to the third pour speed L, and the ladle dipper will continue to tilt forward until it reaches the third pour attitude, at which time the control unit will cause it to stop tilting forward.

The operator can return the ladle dipper to its level upright attitude by actuating the manual pour return switch 209. This will cause the control unit 200 to send signals on the lines 218 and 219 indicating the operation of the ladle dipper motor 111 at the pour return speed M. The operator can return the ladle dipper to the furnace F by actuating the manual retract switch 207. In response to the actuation of this switch, the control unit 200 will supply a signal on lines 217 and 219 indicating the operation of the main motor 31 at the retract-to-metal speed A, and the ladle transport assembly will retract.

If during manual operation of the apparatus A it becomes necessary to dump metal back into the furnace F, the operator can actuate the manual retract switch 207 to return the ladle dipper L to the furnace at the retract-to-metal speed A. The movement of the ladle transport assembly will be halted when the probes 91, 92 detect the presence of metal or when the low metal limit switch 151 is made. The operator then actuates the manual pour switch 208 to cause the ladle dipper to pour the molten metal back into the furnace.

Automatic Operation

Figure 20:
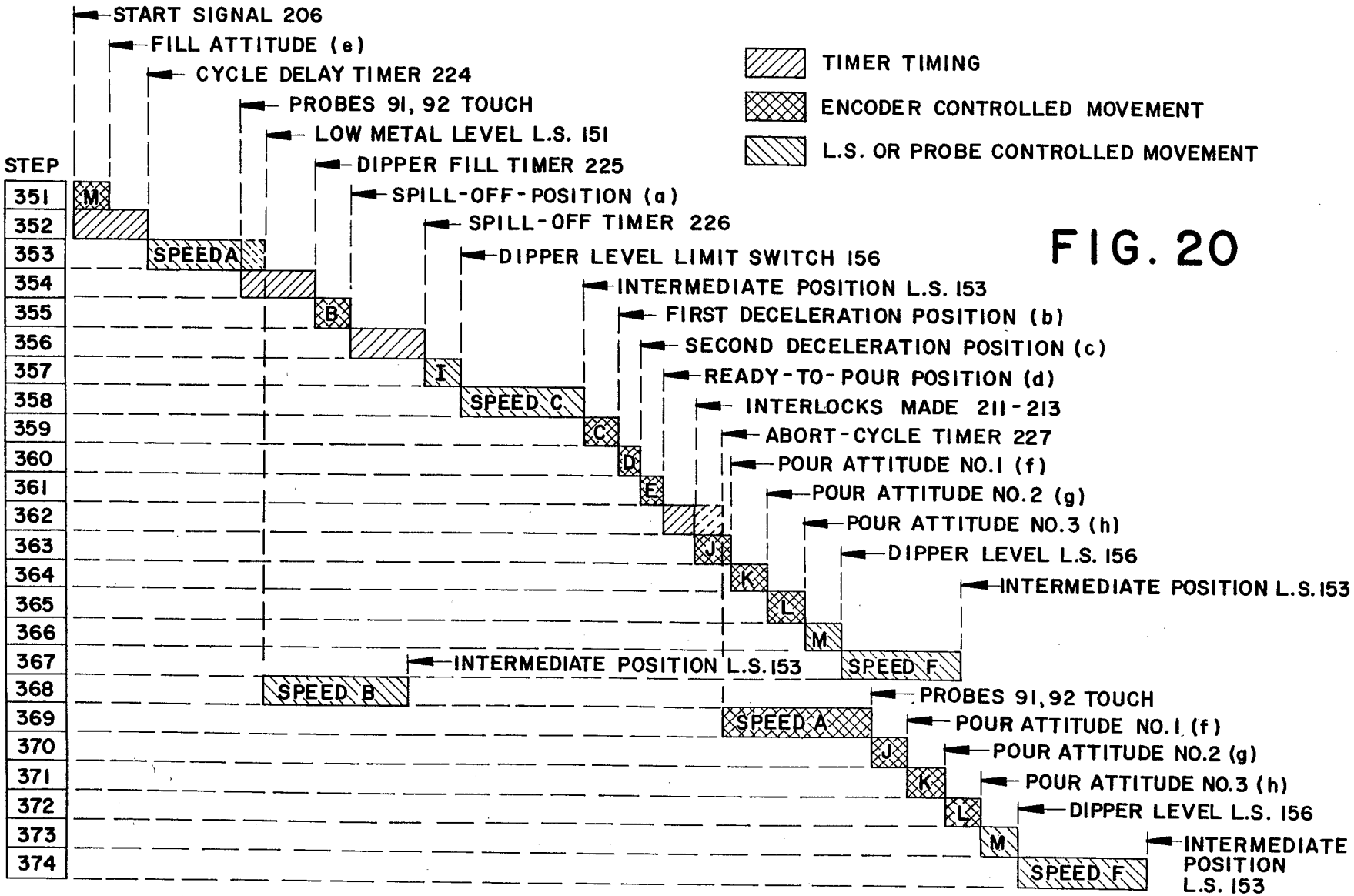
FIG. 20 is a timing chart illustrating the sequence of operation of the control system.

In addition to the manual operating mode, the control unit 200 also provides a completely automatic operating mode in which manual control at each step of the operation is not required, and in which the unit automatically aborts its sequence of operations under certain circumstances. To select the automatic mode of operation, the manual-auto switch 204 is positioned in the "auto" position so that the control unit 200 operates in its automatic mode. The steps in this automatic cycle may be seen with reference to FIG. 20, which shows the sequence of operations in the automatic cycle.

To begin the automatic cycle, the operator either actuates the auto-cycle start switch 205 or the start signal interlock is received on the line 215 from the die casting machine in response to a ladle start cycle signal on line 228. This begins step 351. In response to the actuation of this signal, the ladle dipper is tilted rearwardly to its fill attitude by sending appropriate signals to the motor control circuit on lines 218 and 219. The signal on the line 219 indicates the selection of the dipper motor 111, and the signal on the line 218 indicates the selection of the dipper fill speed H. The dipper is tilted rearwardly at the fill speed H until the dipper is at the predetermined fill attitude as set by the adjustable shot size input 230. The dipper encoder 160 senses when the dipper is at the appropriate attitude and when the attitude is reached, the control unit stops further actuation of the dipper motor 113. At the same time the control unit 200 initiates the delay cycle start timer 224. This comprises step 352.

When the delay cycle start timer 224 times out, step 353 begins. The control unit 200 provides signals on the lines 217 and 219 indicating acutation of the main drive motor 31 at the retract-to-metal speed A. The ladle transport assembly retracts toward the metal in the furnace F at the retract-to-metal speed A, as shown in FIG. 3. The ladle transport assembly will stop retracting either when the metal level sensing probes 91, 92 detect the presence of metal or when the low-metal-level limit switch 151 is made. If the low-metal-level limit switch 151 is made before the probes 91, 92 sense metal, the unit will go into a low-metal-level abort sequence which will be described later with reference to step 368.

If, however, the metal level sensing probes 91 and 92 detect the presence of metal before the low-metal-level limit switch 151 is made, the control unit will continue to step 354. When the metal level sensing probes 91 and 92 make, the dipper-fill timer 225 is initiated. While the dipper-fill timer 225 is running, if the metal level rises enough to touch the high metal level sensing probe 93, the control unit 200 will cause the ladle transport assembly to move forward at the dipper-fill speed B until all of the metal level sensing probes 91, 92, and 93 are out of the metal. The ladle transport assembly will then be retracted at the retract-to-metal speed A until the metal level probes 91 and 92 again touch and the dipper-fill timer 225 will be re-initiated.

After the dipper-fill timer 225 times out, step 355 is performed. The control unit 200 sends signals on lines 217 and 219 designating operation of the main drive motor 31 at the dipper-fill speed B, and the ladle transport assembly will move forward until it reaches the spill-off position (a). The spill-off position (a) is a programmed position and is achieved when the preset count loaded into the counter is counted down to zero by the pulses of the encoder 150. When the spill-off position (a) is reached, step 356 is started. The spill-off timer 226 is initiated and the ladle transport assembly stops for the amount of time set by this timer.

When the spill-off timer 226 times out, step 357 begins. The control unit sends signals on the lines 218 and 219 indicating the return of the ladle dipper to its level transport attitude at the fill-return speed I. The ladle dipper motor 111 then runs at the fill-return speed I until the ladle dipper reaches its level transport attitude as indicated by a making of the dipper level limit switch 156.

Figure 5:
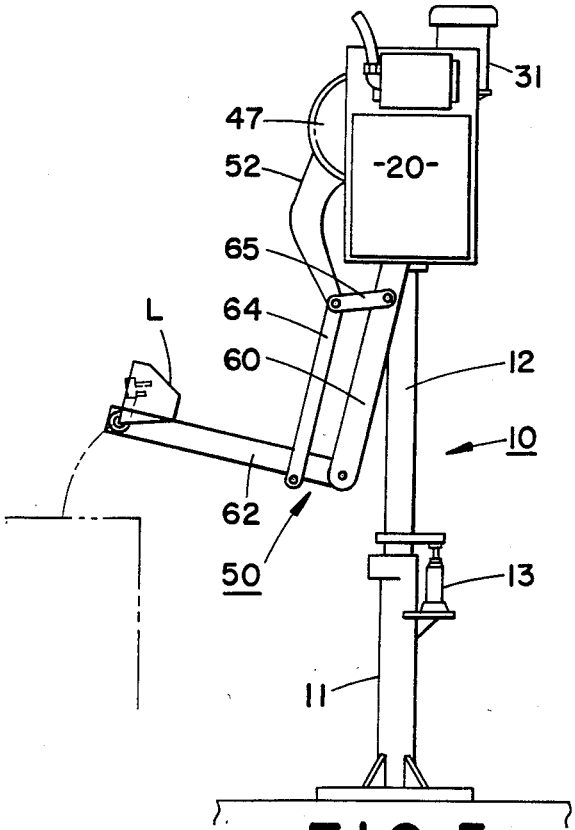

When the switch 156 is made, step 358 begins. The control unit 200 then send signals on the lines 217 and 219 to the motor control circuit 216 indicating actuation of the main drive motor 31 at the forward-to-pour speed C, and the ladle transport assembly moves forward, as shown in FIG. 5. As the ladle transport assembly moves forward, it actuates the intermediate position limit switch 153, indicating that the ladle transport assembly has passed the intermediate rest position. When the intermediate position limit switch 153 is made, step 359 begins. When the limit switch 153 is made, it initiates the abort-cycle timer 227. Meanwhile, the ladle transport assembly continues to move forward at the forward-to-pour speed C until it reaches the first deceleration position (b). The first deceleration position is determined in accordance with the setting of the forward stroke input 229. When the ladle transport assembly reaches the first deceleration position (b), step 360 begins, and the control unit 200 switches the motor 31 to the first deceleration speed D. The ladle transport assembly continues forward at this decreased speed D for a predetermined distance to the second deceleration position (c) as measured by the main encoder 150 at which time step 361 is performed, and the control unit switches to the second deceleration speed E. The ladle transport assembly continues to move forward at the slower speed E for a further predetermined distance to the ready-to-pour position (d) as measured by the main encoder 150, after which the control unit 200 stops further forward movement of the ladle transport assembly.

At this point, step 362 begins. The control unit 200 checks to see whether the dies are closed and locked and the plunger is retracted in the die casting machine D. This is indicated by the signals on the lines 212, 213 and 214. If the control unit 200 receives a die-open signal or if it does not receive a die-locked signal or a plunger-retracted signal, it performs step 369. If the abort-cycle timer 227, which was initiated at the beginning of step 359, times out before the die-locked and plunger-retracted signals are received, the control unit 200 will go into a no-pour abort sequence, which will be described later with reference to steps 369 and 374. If the die-locked or plunger-retracted signals are broken or a die-opened signal is received while the apparatus is pouring metal, the ladle transport assembly will again stop and the abort-cycle timer 227 will be re-initiated.

Figure 6:
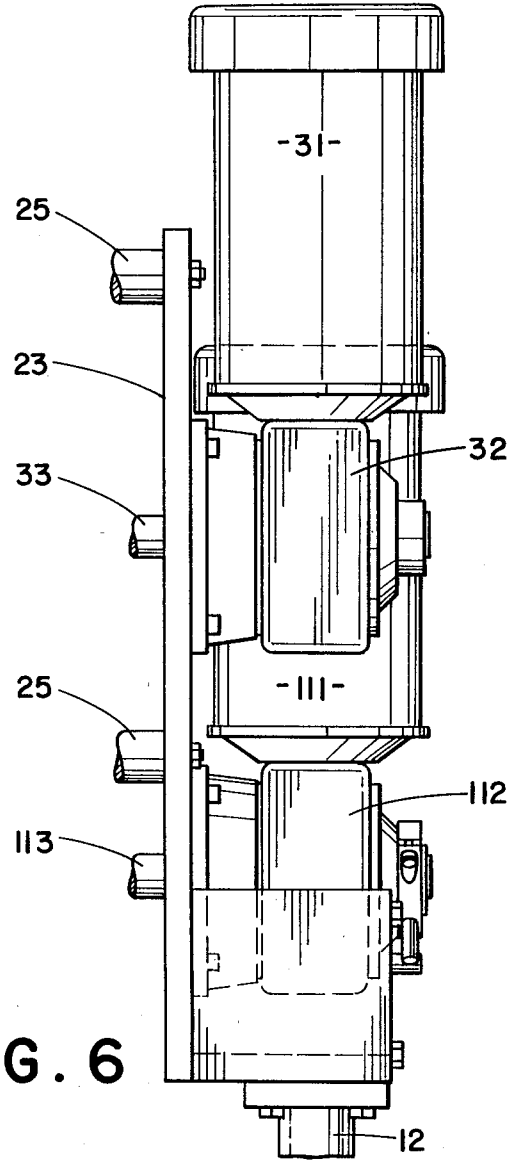
FIG. 6 is a fragmentary end elevation on an enlarged scale of the apparatus of FIG. 1.

If the die-locked and plunger-retracted signals are received by the control unit 200 after the intermediate position limit switch 153 is made, step 363 will be performed, and the ladle dipper L will begin pouring as indicated in FIG. 6. The control unit 200 will initiate pouring by sending signals on the lines 218 and 219 indicating actuation of the dipper motor 111 at the first pour speed J, and the ladle dipper will tilt forward at the first pour speed until it reaches the first pour attitude (d). The first pour attitude (d) is a programmable attitude determined by the encoder 160. When the ladle dipper reaches the first pour attitude (d), step 364 is begun. The control unit 200 changes the speed signal on the line 218 to the second pour speed K, and the ladle dipper continues to tilt forward at the second pour speed until it reaches the second pour attitude (e), as indicated by the encoder 160. At this time, step 365 is performed. The control unit 200 changes to the third pour speed L, and the third pour speed is used until the ladle dipper reaches its full tilted or third pour attitude (f).

When the ladle dipper reaches the third pour attitude (f), as indicated by the encoder 160, step 366 is started. The control unit 200 sends a signal on the line 218, indicating the return of the ladle dipper to its level transport attitude at the pour return speed M. The ladle dipper tilts back to its level attitude until the dipper level limit switch 156 is made indicating that the dipper is level at which time further actuation of the dipper motor 111 stops and step 367 is begun. The control unit 200 then sends signals on the lines 217 and 219 indicating actuation of the main motor 13 at the auto return speed F, and the ladle transport assembly begins retracting. If selected, the control unit 200 will now given an early start cycle signal to the die casting machine D on the line 228. If the early start cycle signal is not selected, the control unit 200 will not give a start cycle signal to the die casting machine D until the intermediate position limit switch 153 is off and the ladle transport assembly has retracted to its intermediate rest position. The transport assembly continues to retract at the speed F until it reaches the intermediate rest position as indicated by the limit switch 153. The control unit 200 then stops the ladle transport assembly and waits for a start signal. When the start signal is received, the delay-cycle start timer 224 initiates, and the automatic cycle is repeated beginning with step 351.

If during step 353, the low-metal-level limit switch 151 is made before the probes 91 and 92 detect metal, then a low-metal-level abort sequence is performed. This sequence comprises step 368. In this sequence, the ladle transport assembly will stop retracting and a low-metal-level indicator light will be turned on in the control panel display 231. The control unit 200 will feed signals on the lines 217 and 219 indicating movement of the main drive motor 31 at the forward speed B, and the ladle transport assembly will move forward until it reaches the intermediate rest position as indicated by the limit switch 153. The transport assembly will wait in this position for a start signal.

If during step 362 the abort-cycle timer 227 times out before the interlocks are made, the control unit 200 will send signals on lines 217 and 219 indicating actuation of the main drive motor 31 at the retract-to-metal speed A, and the ladle transport assembly will retract until the metal level sensing probes 91 and 92 touch the metal in the furnace F as indicated as step 369. Step 370 is then performed. The main motor 31 is stopped, and the dipper motor 111 is actuated by sending an appropriate signal on the line 219. A signal is also sent on the line 218 indicating actuation of the dipper motor 113 at the first pour speed J. The control unit then performs steps 370, 371 and 372 to pour the molten metal back into the furnace in a three stage pouring process similar to steps 363, 364, and 365, with each of the pouring speeds being controlled by the appropriate pouring attitude as indicated by the encoder 160. After the dipper reaches the third pour attitude (f), the control unit sends a signal on line 218 indicating the pour return speed M and the ladle dipper returns to its level transport attitude as indicated by the dipper level limit switch 156. When the switch 156 is made, the control unit 200 sends signals on the lines 217 and 219 actuating the main drive motor 31 at the forward speed B, and the ladle transport assembly moves forward until it reaches its intermediate rest position as indicated by the making of the limit switch 153. The control unit 200 will wait for the next start signal to begin step 301.

Various modifications may be made to the control system. For example, while various motor control speeds are shown as fixed or adjustable, the adjustable control speeds may be fixed and the fixed control speeds may be made adjustable. While three different pouring speeds are disclosed, more or fewer pouring speeds may be utilized, each separated by a programmed intermediate pouring position.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and affect to the specific embodiment herein shown and described, nor in any other way that is inconsistent with the extent to which the progress in the art has been advanced by the invention.

What is claimed is:

1. A control system for a ladling apparatus for ladling molten metal from a reservoir to a casting apparatus horizontally spaced from the reservoir, the ladling apparatus having a ladle transport assembly capable of moving horizontally between the reservoir and the casting apparatus, the ladle dipper capable of tilting to pour molten metal into the casting apparatus, the control system comprising:

means for moving the ladle transport assembly from the metal reservoir to the casting apparatus at varying speeds;

means for tilting the ladle dipper at varying speeds when the ladle transport assembly is at the casting apparatus to pour molten metal into the casting apparatus;

adjustable means for setting a plurality of individual speeds;

means for selecting one of the plurality of speeds;

means for supplying the selected speed from the selecting means to the moving and the tilting means;

means for controlling the selecting means in response to predetermined inputs.

2. A control system as in claim 1, wherein the selecting means includes means for preventing operation of the moving means and the tilting means at the same time.

3. A control system as in claim 1, wherein the moving means and the tilting means are each capable of operating in both forward and backward directions and wherein some of the individual speeds are forward speeds and some of the individual speeds are backward speeds.

4. A control system as in claim 1, comprising in addition timing means connected to the controlling means for delaying the movement of the ladle transport assembly in response to certain of the inputs.

5. A control system as in claim 1, comprising in addition means for monitoring the position of the ladle transport assembly and the ladle dipper and for giving this position to the controlling means as one of the inputs.

6. A control system as in claim 5, wherein the monitoring means includes encoders connected to the moving means and the tilting means and having an output representing movement of the moving means.

7. A control system as in claim 6, wherein the monitoring means comprises in addition limit switches which are engaged by the moving means when the moving means is in a desired position.

8. A control system as in claim 7, wherein the monitoring means comprises in addition probes attached to the ladle transport assembly for sensing the proximity of molten metal to determine the position for the ladle transport assembly relative to the molten metal supply.

9. A control system as in claim 1, comprising in addition display means connected to the supplying means, the display means comprising a forward display for indicating the forward speed at which the moving means is operating and a backward display for indicating the backward speed at which the moving means is operating.

10. A control system as in claim 1, wherein the controlling means is adapted to be connected to a casting machine and to receive status indications from the casting machines as certain of the inputs.

11. A control system as in claim 1, wherein the selecting means comprises a plurality of analog switches connected between the setting means and the moving means.

12. A control system as in claim 11, wherein the analog switches are connected to the controlling means through a decoder which translates a digital control signal from the controlling means into a plurality of individual control signals each of which operates one of the plurality of analog switches.

13. A control system as in claim 1, comprising in addition means connected to the supplying means for visually displaying the speed at which the moving means is operating.

14. A control system as in claim 13, wherein the display means comprises LED bar graph display.

* * * * *